US005468600A

United States Patent [19]

Watanabe et al.

[11] Patent Number: 5,468,600

[45] Date of Patent: Nov. 21, 1995

[54] SILVER HALIDE COLOR PHOTOGRAPHIC MATERIAL

[75] Inventors: Toshiyuki Watanabe; Hiroo Takizawa, both of Ashigara, Japan

[73] Assignee: Fuji Photo Film Co., Ltd., Kanagawa, Japan

[21] Appl. No.: 275,442

[22] Filed: Jul. 15, 1994

[30] Foreign Application Priority Data

Jul. 21, 1993 [JP] Japan ..... 5-179651

[51] Int. Cl.[6] ..... G03C 1/08; G03C 7/26; G03C 7/32

[52] U.S. Cl. ..... 430/546; 430/558; 430/502

[58] Field of Search ..... 430/546, 558, 430/502, 935

[56] References Cited

U.S. PATENT DOCUMENTS

| | | | |
|---|---|---|---|
| 5,294,529 | 3/1994 | Idogaki et al. | 430/546 |
| 5,342,746 | 8/1994 | Zengerle et al. | 430/546 |

FOREIGN PATENT DOCUMENTS

| | | |
|---|---|---|
| 0422595 | 4/1991 | European Pat. Off. . |
| 0486929 | 5/1992 | European Pat. Off. . |
| 0491317 | 6/1992 | European Pat. Off. . |
| 601836 | 6/1994 | European Pat. Off. . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A silver halide color photographic material is described, comprising a support having provided thereon at least one light-sensitive silver halide emulsion layer(s), wherein at least one of said silver halide emulsion layer(s) comprises a high boiling organic solvent represented by the following formula (SO):

(SO)

wherein Y represents a substituent group represented by the following formula (A) or (B):

(A)

(B)

wherein $R_{21}$ in the formula (A) represents an aliphatic or aryl group containing 9 to 40 carbon atoms, and $R_{22}$ and $R_{23}$ in the formula (B) each represents an aliphatic or aryl group containing 6 to 40 carbon atoms.

17 Claims, No Drawings

SILVER HALIDE COLOR PHOTOGRAPHIC MATERIAL

FIELD OF THE INVENTION

The present invention relates to a silver halide photographic material and, more particularly, to a silver halide photographic material which enables improvement in color formation activity of couplers. Further, it is concerned with a silver halide color photographic material which has improved resistance to the fluctuation due to variation of processing factors in its performance upon photographic processing.

BACKGROUND OF THE INVENTION

In recent years, color photographic materials have made a marked progress in the increase of their photographic speed and in the improvement of image qualities which they can provide. The diversification of the image size (format) has also advanced. Under these circumstances, there has been created a growing demand for color photographic materials which can ensure higher photographic speed and higher image quality.

The image quality of photographs obtained by users, however, depends largely on whether or not the photographs undergo proper photographic processing. With respect to the photographic processing, diversification of facilities therefor (e.g., the spread of minilaboratory and over-the-counter processing), reduction of processing time and decrease in amounts of replenishers have rapidly proceeded. These processing conditions are in fact responsible for fluctuation in processing results.

Color photographic materials, especially color reversal materials, are greatly influenced by processing factors. In designing color photographic materials, therefore, it becomes an important problem to lessen the dependence of their performance on processing factors.

Such being the case, not only further increase in photographic speed and image quality but also reduction in performance deterioration due to processing factors are urgently required of color photographic materials.

On the other hand, dyes produced from conventional yellow, magenta and cyan couplers in silver halide color photographic materials had unnecessary side absorptions, and so they were apt to fail in satisfactory color reproduction. Thus, for compensating such dyes for their side absorptions, loads, including the use of colored couplers and the provision of excess interimage effect, have been imposed on photographic materials. Therefore, development of new couplers showing reduced side absorption have been tried.

As for the magenta dyes, there have been noted the improvement in hue by using pyrazoloazole magenta couplers instead of conventional 5-pyrazolone magenta couplers. Those couplers are disclosed, e.g., in U.S. Pat. No. 3,725,067, JP-A-60-172982 (the term "JP-A" as used herein means an "unexamined published Japanese patent application"), JP-A-60-33552, JP-A-61-72238, and U.S. Pat. Nos. 4,500,630, 4,540,654 and 5,021,352.

The azomethine dyes produced from these couplers and oxidized products of color developing agents are known to be more favorable for color reproduction than those produced from 5-pyrazolone magenta couplers, because the former dyes have less side absorption in the vicinity of 430 nm than the later dyes.

However, pyrazoloazole magenta couplers have drawbacks such that their color formability is low, they are less resistant to fluctuation in their performance due to variation of processing factors, they have bad influences upon the storage stability of photographic materials and the color images produced therefrom are inferior in keeping property. Thus, it is the present situation that any wholly satisfactory usage of those couplers is not yet established.

Improvements in the color formability of couplers, the keeping property of color images, the extent of manifesting the effects of functional ingredients (including a color mixture preventive, DIR compounds and so on) and so on are well known to depend on the species of high boiling organic solvents generally used for dissolution and dispersion of couplers. Phthalate compounds and phosphate compounds are superior in solubility and dispersibility of couplers, affinity to colloids such as gelatin, hue of developed color images, stability, market price and so on. Therefore, such organic solvents have been prevailingly used. However, they cannot produce fine effects on solution of the aforementioned problems which pyrazoloazole magenta couplers have.

Hitherto, there have been proposed various arts of using pyrazoloazole magenta couplers. With the intention of heightening color formability, for instance, European Patent No. 0,486,929 discloses the method of using higher alcohols, while European Patent No. 0,491,317 discloses the method of using hydroxybenzoate. In addition, it is disclosed in European Patent No. 0,422,595 that those couplers can be rendered more resistant to the fluctuation in their performance due to variation of processing factors by the use of compounds containing a hydroxy group and an ester linkage.

Although the above-described art actually achieve some effect on reduction of performance fluctuation, it is still insufficient for the reduction of performance fluctuation arising from variation of processing factors present in the market. Accordingly, further improvement is required of the art as described above.

Further, JP-B-47-8745 (which corresponds to U.S. Pat. No. 3,650,759, and in which the term "JP-B" means an examined Japanese patent publication ) discloses 1,2-glycols as sensitizer for Roentgen films and black-and-white photographic materials. However, it has neither description such as "1,2-glycols contain an aliphatic or aryl group containing not less than 9 carbon atoms", nor suggestion that application of 1,2-glycols to color photographic materials will bring about improvements in color formability and performance fluctuation due to variation of processing factors.

Furthermore, JP-B-54-24289 discloses that 1,2-glycol is effective for stabilizing dispersion of photographic additives and inhibiting variation in hue during preservation under high temperature and high humidity conditions. However, JP-54-24289 is silence about the improvement in color forming ability and the pyrazoloazole coupler.

SUMMARY OF THE INVENTION

An object of the present invention is to provide a high boiling organic solvent which can impart excellent color formation characteristics to couplers.

Another object of the present invention is to provide a silver halide color photographic material which ensures excellent color formation.

A further object of the present invention is to provide a silver halide color photographic material which has strong resistance to performance fluctuation due to variation of processing factors.

The above-described objects of the present invention are attained with photographic materials having constitutions (1) to (5) described below.

That is, in the constitution (1), a silver halide color photographic material comprises a support having provided thereon at least one light-sensitive silver halide emulsion layer(s), wherein at least one of said silver halide emulsion layer(s) comprises a high boiling organic solvent represented by the following formula (SO):

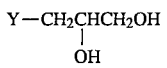

(SO)

wherein Y represents a substituent group represented by the following formula (A) or (B):

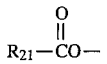

(A)

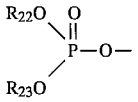

(B)

wherein $R_{21}$ in the formula (A) represents an aliphatic or aryl group containing 9 to 40 carbon atoms, and $R_{22}$ and $R_{23}$ in the formula (B) each represents an aliphatic or aryl group containing 6 to 40 carbon atoms.

In the constitution (2), a silver halide color photographic material comprises a support having provided thereon at least one light-sensitive silver halide emulsion layer(s), wherein at least one of said silver halide emulsion layer(s) comprises both a high boiling organic solvent represented by the following formula (SO) and a coupler represented by the following formula (M):

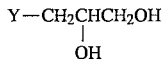

(SO)

wherein Y represents a substituent group represented by the following formula (A), (B) or (C):

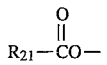

(A)

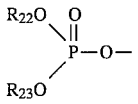

(B)

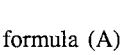

(C)

wherein $R_{21}$ in the formula (A) represents an aliphatic or aryl group containing 9 to 40 carbon atoms, $R_{22}$ and $R_{23}$ in the formula (B) each represents an aliphatic or aryl group containing 6 to 40 carbon atoms, and $R_{24}$ in the formula (C) represents an aliphatic or aryl group containing 6 to 40 carbon atoms;

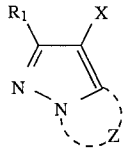

(M)

wherein $R_1$ represents a hydrogen atom or a substituent group, Z represents non-metal atoms necessary to form a 5-membered azole ring containing 2 to 4 nitrogen atoms, which azole ring may have a substituent group (including a heterocyclic group), and X represents a group capable of splitting off upon coupling reaction with an oxidation product of a developing agent.

In the constitution (3), a silver halide color photographic material comprises a support having provided thereon at least one light-sensitive silver halide emulsion layer(s), wherein at least one of said silver halide emulsion layer(s) comprises both a high boiling organic solvent represented by the following formula (SO) and a coupler represented by the following formula (M):

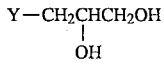

(SO)

wherein Y represents a substituent group represented by the following formula (A) or (B):

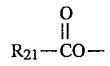

(A)

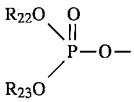

(B)

wherein $R_{21}$ in the formula (A) represents an aliphatic or aryl group containing 9 to 40 carbon atoms, and $R_{22}$ and $R_{23}$ in the formula (B) each represents an aliphatic or aryl group containing 6 to 40 carbon atoms;

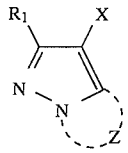

(M)

wherein $R_1$ represents a hydrogen atom or a substituent group, Z represents non-metal atoms necessary to form a 5-membered azole ring containing 2 to 4 nitrogen atoms, which azole ring may have a substituent group (including a heterocyclic group), and X represents a group capable of splitting off upon coupling reaction with an oxidation product of a developing agent.

In the constitution (4), the silver halide color photographic material having the constitution ( 1 ) or ( 2 ) has the ratio of the weight of the high boiling organic solvent to the weight of the coupler ranges from 0.01 to 10.

In the constitution (5), the silver halide color photographic material having the constitution (3) is subjected to color development after black-and-white development.

In the constitution (6), the silver halide color photographic material having the constitution (3) is processed in a development step using a color developer the pH of which is not lower than 11.

DETAILED DESCRIPTION OF THE INVENTION

The present invention is described below in detail.

First, the compound represented by the formula (SO) is illustrated below in detail.

Additionally, when substituent groups recited herein have an aliphatic moiety, the aliphatic moiety may take any of straight-chain, branched chain and cyclic forms (e.g., the form of cycloalkyl), may be saturated or unsaturated (such as alkenyl), and may further contain a substituent, unless otherwise indicated. It is desirable for such an aliphatic moiety to be an alkyl or alkenyl.

When substituent groups recited herein have an aryl moiety, on the other hand, the aryl moiety may further be substituted or unsubstituted, and may take the form of single ring (such as phenyl) or condensed ring (such as naphthyl). It is desirable for such an aryl moiety to be a phenyl.

As for the substituents which the foregoing aliphatic, aryl and heterocyclic moieties each may contain, suitable examples thereof include an aliphatic group, an aryl group, an aliphatic oxy group, an aryloxy group, an aliphatic oxycarbonyl group, an aryloxycarbonyl group, an acylamino group, a sulfonamido group, a carbamoyl group, a sulfamoyl group, an alkoxysulfonyl group, a heterocyclic group, an acyl group, an acyloxy group and a halogen atom.

In the formula (SO), Y is a substituent group represented by the formula (A), (B) or (C). $R_{21}$ in the formula (A) represents an aliphatic or aryl group containing 9 to 40 carbon atoms. $R_{22}$ and $R_{23}$ in the formula (B) and $R_{24}$ in the formula (C) each represents an aliphatic or aryl group containing 6 to 40 carbon atoms. Examples of the aliphatic groups include hexyl, octyl, 2-ethylhexyl, cyclohexyl, nonyl, t-octyl, dodecyl, 2-hexyldecyl, palmityl, oleyl, stearyl, benzyl, and 2-butoxyethyl, and examples of the aryl groups include phenyl, naphthyl, 3-methylphenyl, 2-chlorophenyl, 4-methoxyphenyl, 4-dodecylphenyl, and 4-phenoxyphenyl. Of these substituent groups, it is preferable for $R_{21}$ in the formula (A) to be an aliphatic group containing 9 to 40 carbon atoms, particularly an unsubstituted aliphatic group containing 11 to 30 carbon atoms, and for $R_{22}$ and $R_{23}$ in the formula (B) and $R_{24}$ in the formula (C) each to be an aliphatic group containing 6 to 40 carbon atoms, particularly an unsubstituted aliphatic group containing 8 to 30 carbon atoms.

In the formula (C), m represents an integer of 0 or 1, preferably 1.

In the formula (SO), it is preferable for Y to be an substituent group represented by the formula (A) or (B), particularly an substituent group represented by the formula (A). Herein, $R_{21}$ is preferably an aliphatic group containing 9 to 40 carbon atoms, particularly an unsubstituted aliphatic group containing 11 to 30 carbon atoms.

Specific examples of $R_{21}$, $R_{22}$, $R_{23}$ and $R_{24}$ in the formulae (A), (B) and (C) are illustrated below. However, the present invention should not be construed as being limited to these examples.

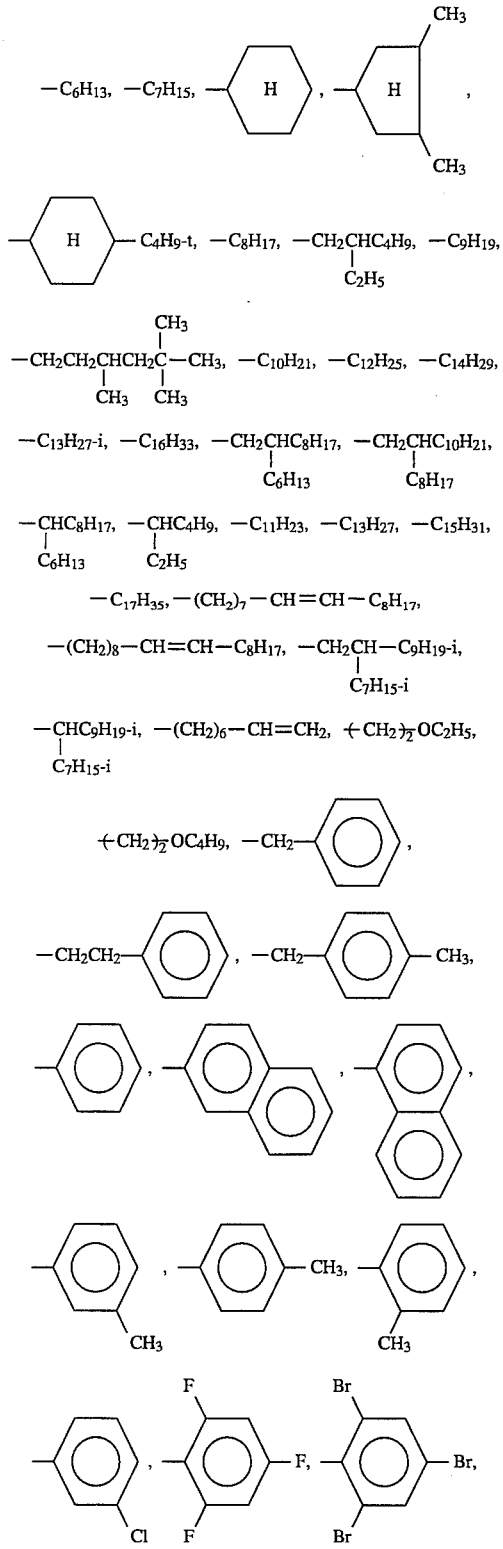

-continued
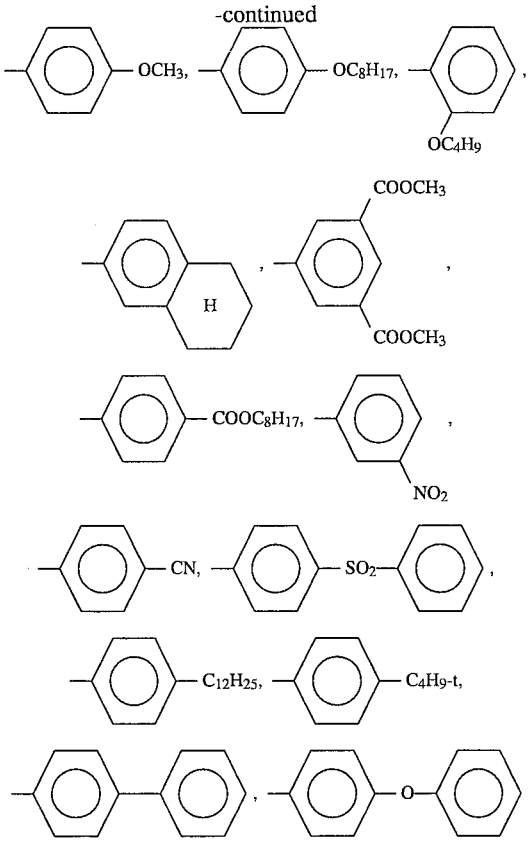
Specific examples of the compound represented by the formula (SO) according to the present invention are illustrated below. However, the present invention should not be construed as being limited to these examples.
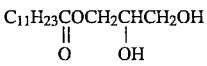
SO-1
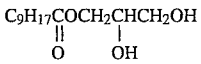
SO-2
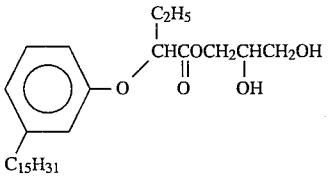
SO-3
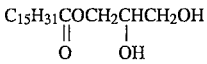
SO-4
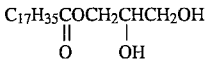
SO-5
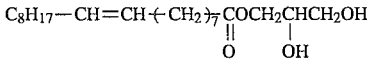
SO-6
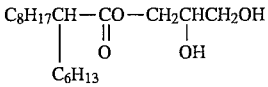
SO-7
-continued
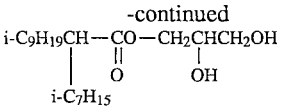
SO-8
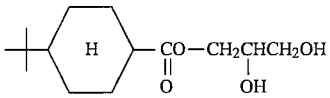
SO-9
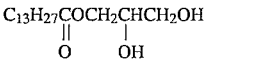
SO-10
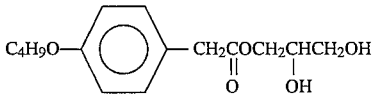
SO-11
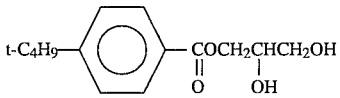
SO-12
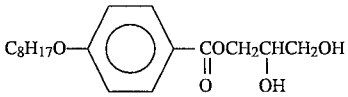
SO-13
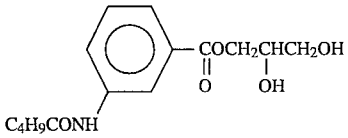
SO-14
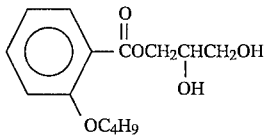
SO-15
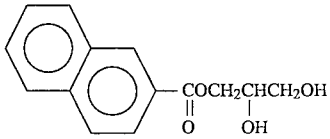
SO-16
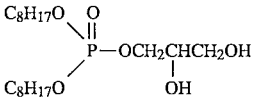
SO-17
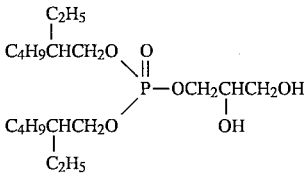
SO-18
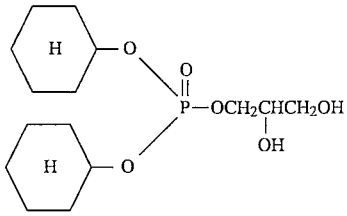
SO-19

-continued
SO-20
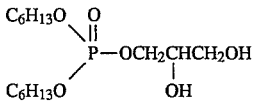
SO-21
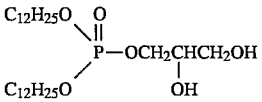
SO-22
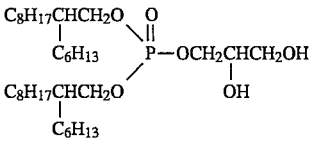
SO-23
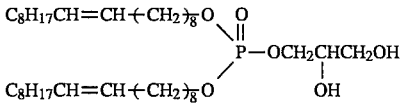
SO-24
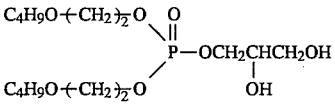
SO-25
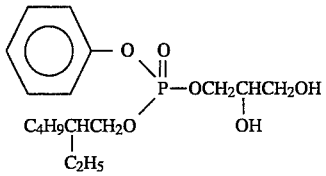
SO-26
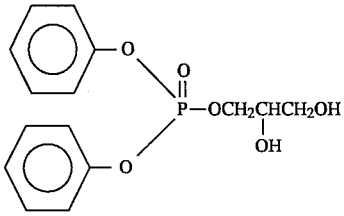
SO-27
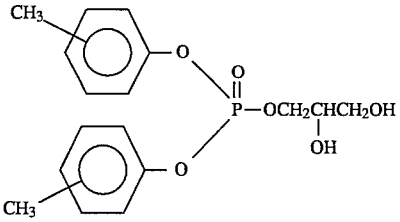
SO-28
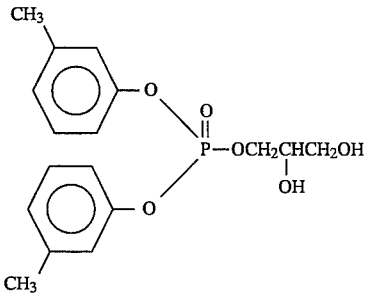
-continued
SO-29
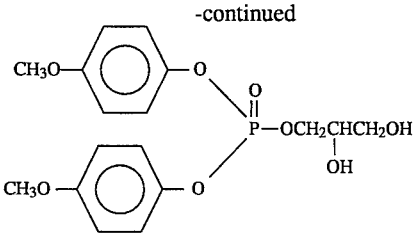
SO-30
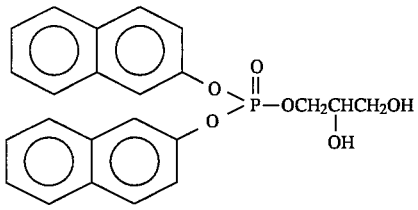
SO-31
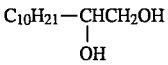
SO-32
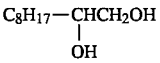
SO-33
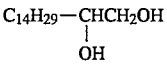
SO-34
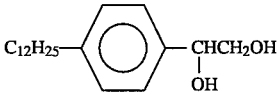
SO-35
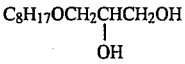
SO-36
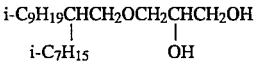
SO-37
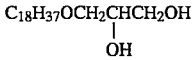
SO-38
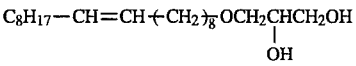
SO-39
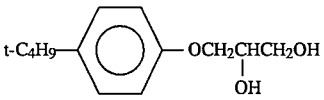
SO-40
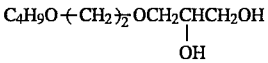
SO-41
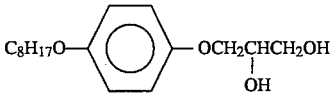
SO-42
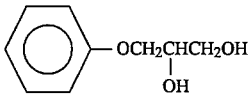
SO-43
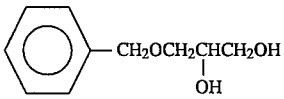

-continued

SO-44

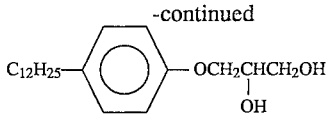

SO-45

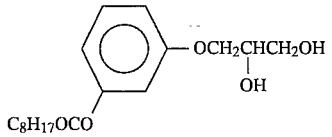

SO-46

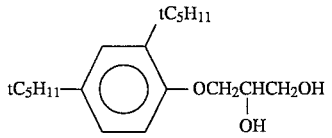

Some of the compounds represented by the formula (SO) according to the present invention are commercially available, and even those which are not on the market can be easily prepared by known reactions, e.g., the reaction of glycerine with an acid chloride or a bromine compound.

The compounds represented by the formula (SO) according to the present invention function mainly as high boiling organic solvent. The expression "high boiling" as used herein signifies the boiling at a temperature not lower than 175° C. under ordinary pressure. In using the compounds of the formula (SO), the amount thereof can be changed depending on the purpose of using them. Therefore, it has no particular limitation. However, it is desirable that the amount of the compound according to the present invention used be in the range of 0.0002 to 20 g, preferably 0.001 to 5 g, per square meter of photographic material. In general, it is desirable that the ratio of the weight of the compound according to the present invention to the weight of a photographically useful agent, such as a coupler, be in the range of 0.01 to 10, preferably 0.1 to 4, more preferably 0.1 to 2.

The proportion of a dispersion which comprises the compound of the formula (SO) according to the present invention and a photographically useful agent, such as a coupler, to a dispersing medium is set at 2-0.1 to 1, preferably 1.0-0.2 to 1, by weight. A typical representative of the dispersing media usable herein is gelatin. In addition, hydrophilic polymers such as polyvinyl alcohol can also be used as dispersing medium. In addition to the compounds according to the present invention and photographically useful agents, the dispersion used in the present invention can optionally contain various compounds depending on the intended purpose of the resulting photographic material.

The compounds represented by the formula (SO) according to the present invention can be used together with conventional high boiling organic solvents. In such a case, it is desirable that the compounds according to the present invention be used in a proportion of at least 10% by weight, preferably at least 30% by weight, to the whole high boiling organic solvents.

Examples of a high boiling organic solvent which can be used together with the compounds according to the present invention are described, e.g., in U.S. Pat. No. 2,322,027. Specific examples of a high boiling organic solvent which has a boiling point not lower than 175° C. at ordinary pressure include phthalic acid esters (e.g., dibutyl phthalate, dicyclohexyl phthalate, di-2-ethylhexyl phthalate, didecyl phthalate, bis (2,4-di-tert-amylphenyl ) phthalate, bis( 2,4-di-tert-amylphenyl) isophthalate, bis (1,1-diethylpropyl) phthalate), phosphoric or phosphonic acid esters (e.g., triphenyl phosphate, tricresyl phosphate, 2-ethylhexyl-diphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate), benzoic acid esters (e.g., 2-ethylhexyl benzoate, dodecyl benzoate, 2-ethylhexyl-p-hydroxybenzoate), amides (e.g., N,N-diethyldodecanamide, N,N-diethyllaurylamide, N-tetradecylpyrrolidone), sulfonamides (e.g., N-butylbenzenesulfonamide), alcohols or phenols (e.g., isostearyl alcohol, 2,4-di-tertamylphenol), aliphatic carboxylic acid esters (e.g., bis(2-ethylhexyl) cebacate, dioctyl azelate, glycerol tributyrate, isostearyl lactate, trioctyl rosylate), aniline derivatives (e.g., N,N-dibutyl-2-butoxy-5-tert-octylaniline), hydrocarbons (e.g., paraffin, dodecylbenzene, diisopropylnaphthalene), chlorinated paraffins, and so on. In addition, organic solvents having a boiling point in the range of from 30° C. preferably 50° C., to about 160° C. can be used as auxiliary solvent. Typical examples of such an auxiliary solvent include ethyl acetate, butyl acetate, ethyl propionate, methyl ethyl ketone, cyclohexanone, 2-ethoxyethyl acetate, dimethylformamide and so on.

When the compounds represented by the formula (SO) according to the present invention are incorporated in the silver halide emulsion layer containing a magenta dye-forming coupler represented by the formula (M), the color forming ability of the magenta dye formed can be considerably improved.

The compounds of the formula (M) relating to the present invention are illustrated below in detail.

Of the coupler skeletons represented by the formula (M) which can be used in the present invention, 1H-imidazo-[1, 2-b]pyrazole, 1H-pyrazolo[1,5-b][1,2,4]triazole, 1Hpyrazolo[5,1-c ] [ 1,2,4 ]triazole and 1H-pyrazolo[ 1,5-d]tetrazole are preferable, and the corresponding couplers are represented by the following formulae (M-I), (M-II), (M-III) and (M-IV) respectively.

Of these couplers, the compounds represented by general formulae (M-II) and (M-III) respectively are much preferred.

(M-I)

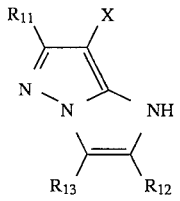

(M-II)

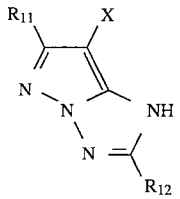

(M-III)

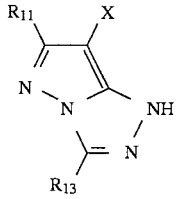

-continued

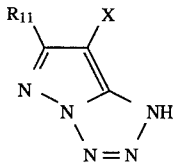

(M-IV)

The substituent groups $R_{11}$, $R_{12}$, $R_{13}$ and X in the foregoing formulae are described below in detail.

$R_{11}$ represents a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclyloxy group, an azo group, an acyloxy group, a carbamoyloxy group, a silyloxy group, an aryloxycarbonylamino group, an imido group, a heterocyclylthio group, a sulfinyl group, a phosphonyl group, an aryloxycarbonyl group, an acyl group or an azolyl group. Further, $R_{11}$ may be a divalent group via which a bis body is formed.

In more detail, $R_{11}$ represents a hydrogen atom, a halogen atom (e.g., chlorine, bromine), an alkyl group (including a straight-chain or branched alkyl group containing 1 to 32 carbon atoms, an aralkyl group, an alkenyl group, an alkinyl group, a cycloalkyl group and a cycloalkenyl group, examples of which are methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecanamido}phenyl }propyl, 2-ethoxytridecyl, trifluoromethyl, cyclopentyl, 3- (2,4-di-t-amylphenoxy)propyl and so on), an aryl group (e.g., phenyl, 4-t-butylphenyl, 2,4-di-t-amylphenyl, 4-tetradecanamidophenyl), a heterocyclic group (e.g., 2-furyl, 2-thienyl, 2-pyrimidinyl, 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoylphenoxy), an acylamino group (e.g., acetamido, benzamido, tetradecanamido, 2- (2,4-di-t-amylphenoxy) butanamido, 4-(3-t-butyl-4-hydroxyphenoxy)butanamido, 2-{4(4-hydroxyphenylsulfonyl)phenoxy}decanamido), an alkylamino group (e.g., methylamino, butylamino, dodecylamino, diethylamino, methylbutylamino ), an anilino group (e.g., phenylamino, 2-chloroanilino, 2-chloro-5-tetradecanaminoanilino, 2-chloro-5-dodecyloxycarbonylanilino, N-acetylanilino, 2-chloro-5-{α-(3-t-butyl-4-hydroxyphenoxy)dodecanamido}anilino), an ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecanamidophenylthio), an alkoxycarbonylamino group (e.g., methoxycarbonylamino, tetradecyloxycarbonylamino), a sulfonamido group (methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl )carbamoyl, N-methyl-N-dodecylcarbamoyl, N-(3-(2,4-di-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclyloxy group (e.g., 1-phenyltetrazole-5-oxy, 2-tetrahydropyranyloxy), an azo group (e.g., phenylazo, 4-methoxyphenylazo, 4-pivaroylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclylthio group (e.g., 2-benzothiazolylthio, 2,4-di-phenoxy-1,3,5-trizole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl ) or an azolyl group (e.g., imidazolyl, pyrazolyl, 3-chloro-pyrazole-1-yl, triazolyl).

These groups may further have a halogen atom or such an organic substituent as to be attached thereto via its carbon, oxygen, nitrogen or sulfur atom, if they can have any substituent.

The groups preferred as $R_{11}$ are an alkyl group, an aryl group, an alkoxy group, an aryloxy group, an alkylthio group, an ureido group, an urethane group and an acylamino group.

$R_{12}$ includes the same groups as recited with respect to $R_{11}$, and the groups preferred as $R_{12}$ are a hydrogen atom, an alkyl group, an aryl group, a heterocyclic group, an alkoxycarbonyl group, a carbamoyl group, a sulfamoyl group, a sulfinyl group, an acyl group and a cyano group.

$R_{13}$ includes the same groups as recited with respect to $R_{11}$, and the groups preferred as $R_{13}$ are a hydrogen atom, an alkyl group, an aryl group, a heterocyclic group, an alkoxy group, an aryloxy group, an alkylthio group, an arylthio group, an alkoxycarbonyl group, a carbamoyl group and an acyl group. Of these groups, an alkyl group, an aryl group, a heterocyclic group, an alkylthio group and an arylthio groups are preferred in particular.

X represents a hydrogen atom or a group capable of splitting off upon reaction with the oxidation product of an aromatic primary amine color developing agent. Specific examples of such a splitting-off group include a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclylthio group, a carbamoylamino group, a 5- or 6-membered nitrogen-containing heterocyclic group, an imido group and an arylazo group. These groups each may be substituted with groups allowable as substituents of $R_{11}$.

More specifically, the splitting-off group represented by X includes a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyrylamino), an alkyl- or arylsulfonamido group (e.g., methanesulfonamido, trifluoromethanesulfonamido, p-toluenesulfonamido), an alkoxycarbonyloxy group (e.g., ethoxycarbonyloxy, benzyloxycarbonyloxy), an aryloxycarbonyloxy group (e.g., phenoxycarbonyloxy), an alkyl-, aryl- or heterocyclylthio group (e.g., dodecylthio, 1-carboxydodecylthio, phenylthio, 2-butoxy-5-t-octylphenylthio, tetrazolylthio), a carbamoylamino group (e.g., N-methylcarbamoylamino, N-phenylcarbamoylamino), a 5- or 6-membered nitrogen-containing heterocyclic group (e.g., imidazolyl, pyrazolyl, triazolyl, tetrazolyl, 1,2-dihydro- 2-oxo- 1-pyridyl), an imido group (e.g., succinimido, hydantoinyl) and an arylazo group (e.g., phenylazo, 4-methoxyphenylazo). In addition to these groups, X can be a splitting-off group to be attached via its carbon atom. In such a case, the resulting coupler takes a bis form obtained by condensing four equivalent couplers by the use of an aldehyde or a ketone. Further, X may contain a photographically useful group such as a development inhibitor, a development accelerator or so on. Those preferred as X are a halogen atom, an alkoxy group, an aryloxy group, an alkylthio group, an arylthio group and a 5- or 6-membered nitrogen-containing heterocyclic group to be attached to the coupling active site via its nitrogen atom.

Specific examples of the magenta coupler represented by the foregoing formula (M) are illustrated below. However, magenta couplers which can be used in the present invention should not be construed as being limited to these compounds.

(M-1)

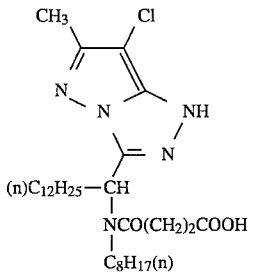

(M-2)

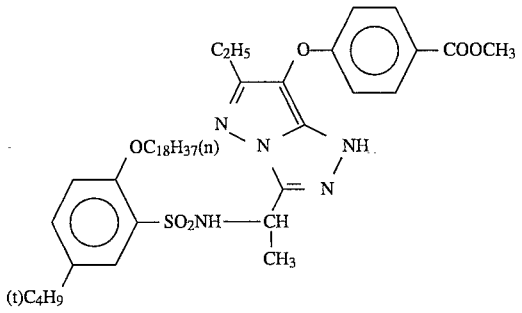

(M-3)

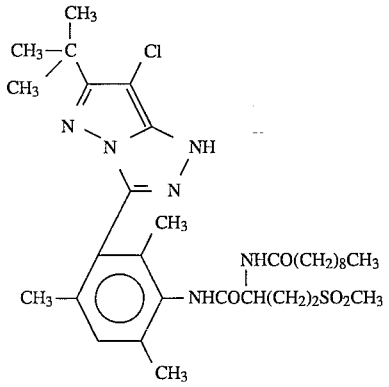

-continued
(M-4)
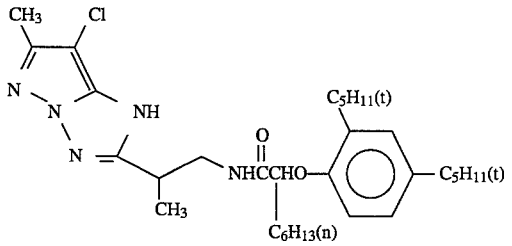
(M-5)
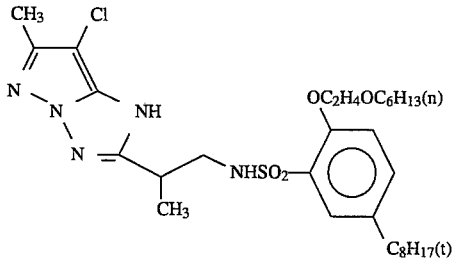
(M-6)
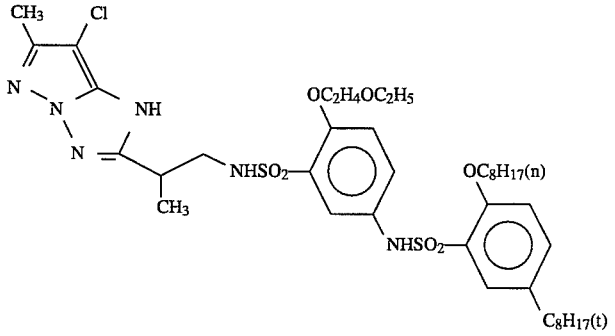
(M-7)
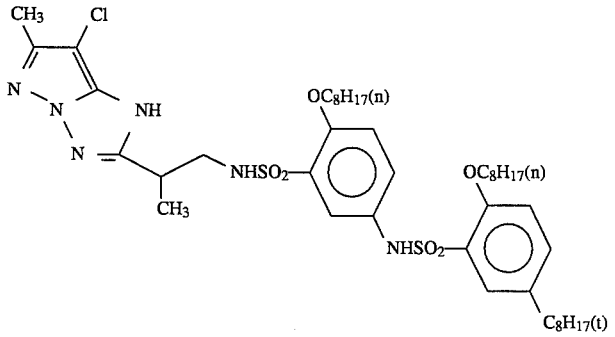
(M-8)
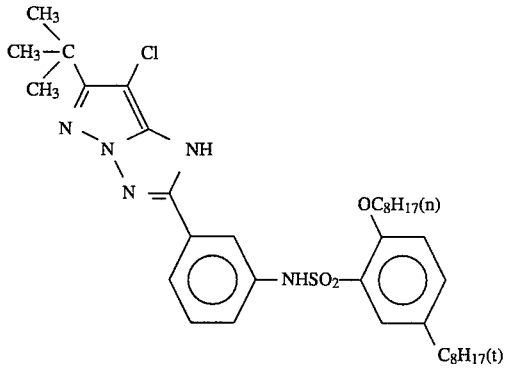

-continued
(M-9)
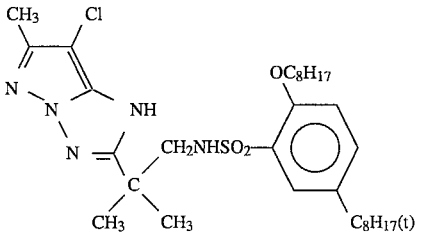
(M-10)
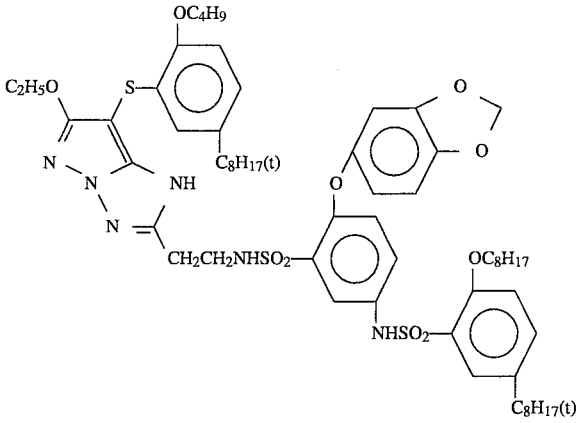
(M-11)
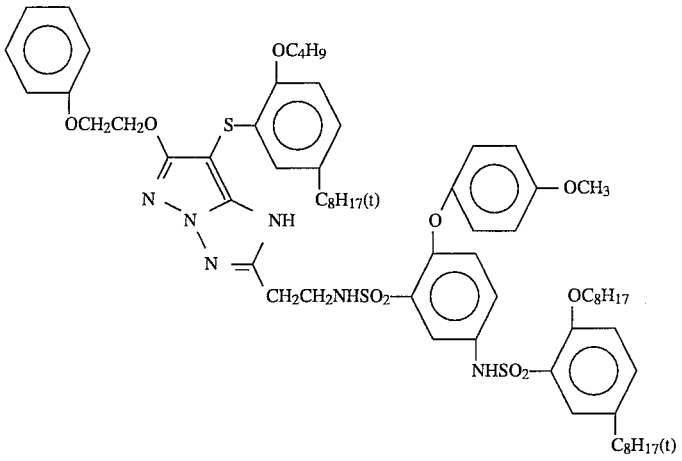
(M-12)
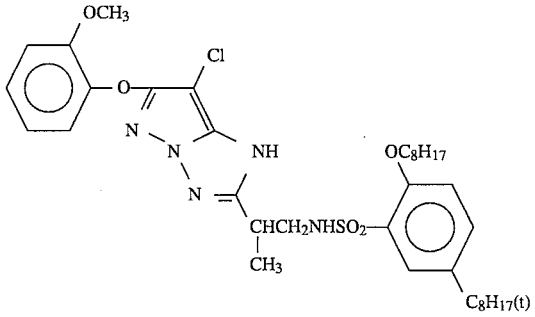

-continued
(M-13)
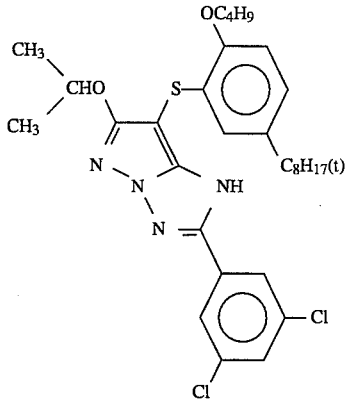
(M-14)
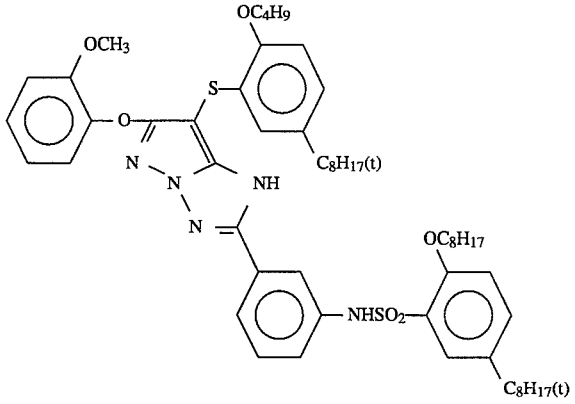
(M-15)
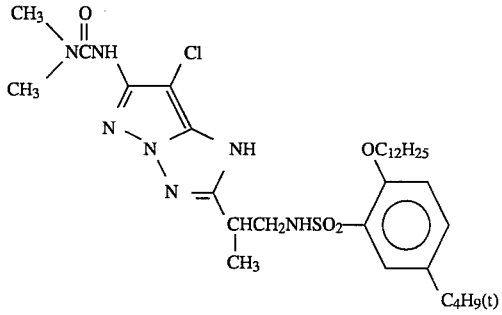
(M-16)
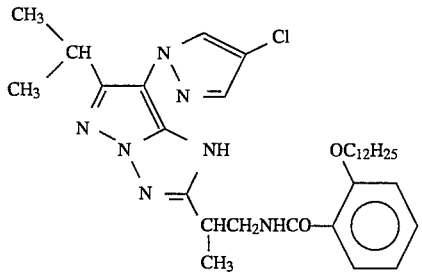
(M-17)
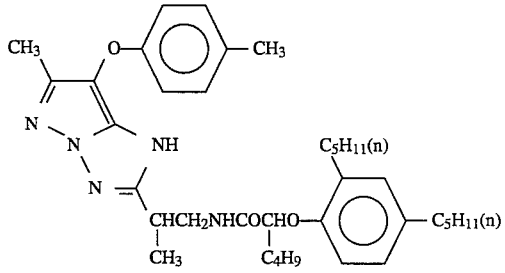

-continued
(M-18)
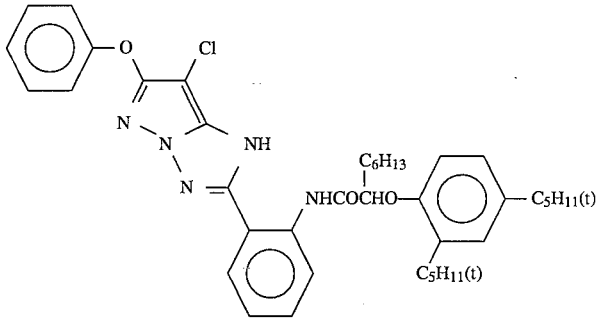
(M-19)
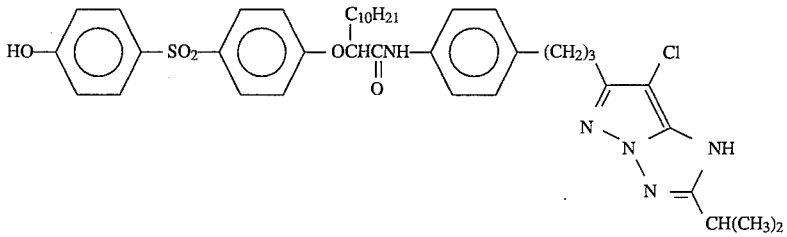
(M-20)
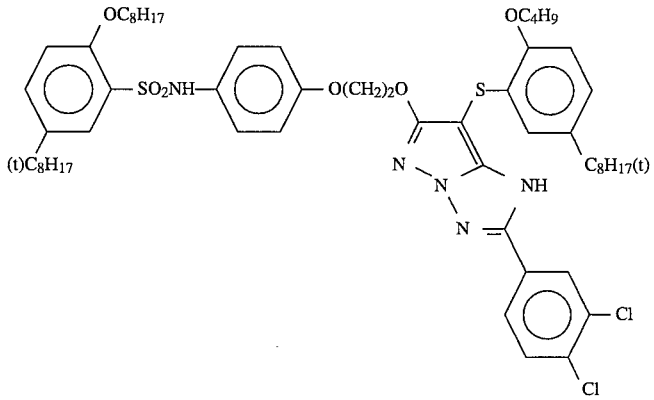
(M-21)
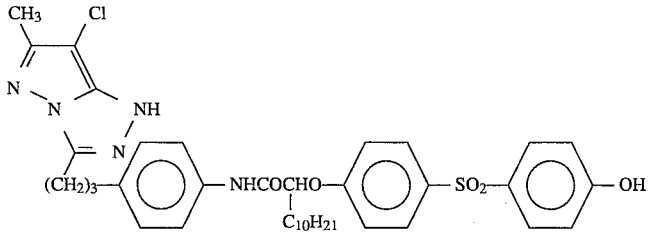
(M-22)
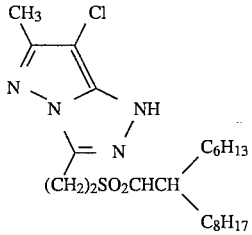

-continued
(M-23)
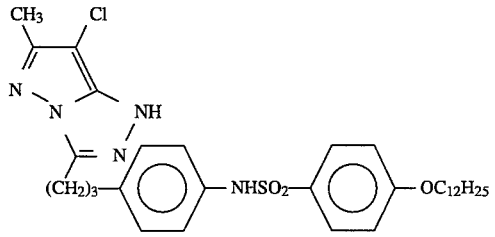
(M-24)
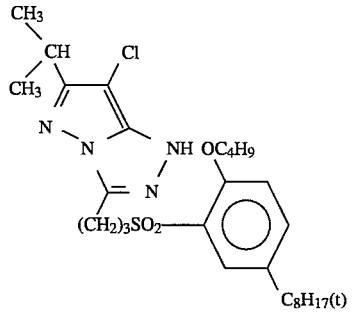
(M-25)
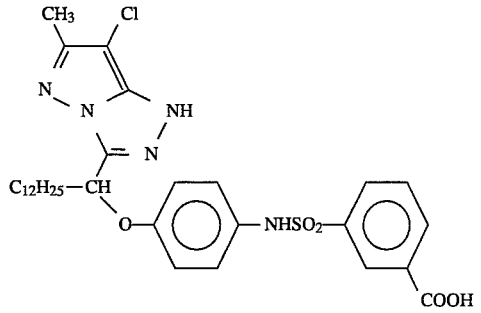
(M-26)
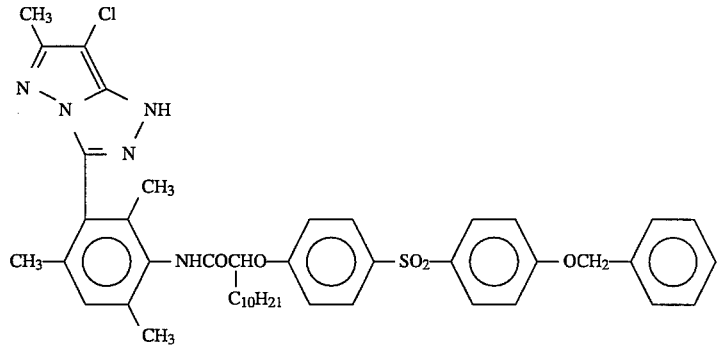
(M-27)
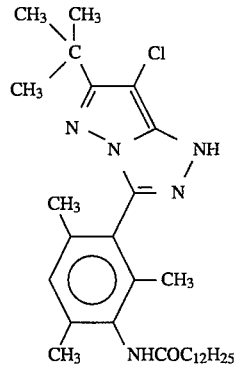

-continued
(M-28)
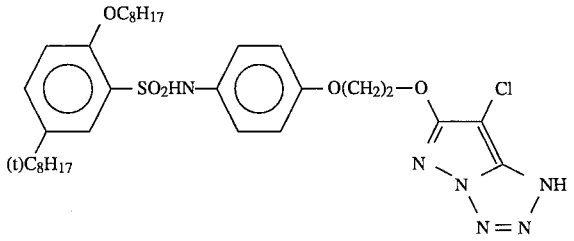
(M-29)
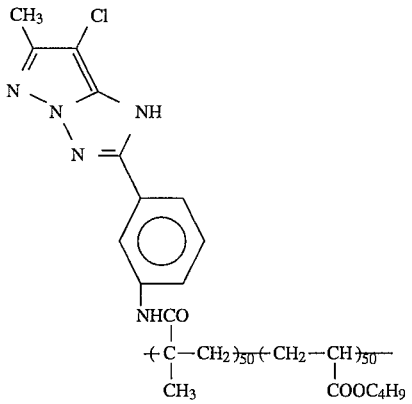
(subscript figures: ratio of monomers constituting copolymer (weight ratio))
(M-30)
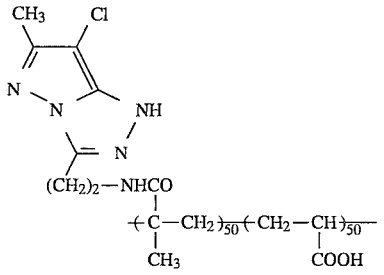
(subscript figures: ratio of monomers constituting copolymer (weight ratio))
(M-31)
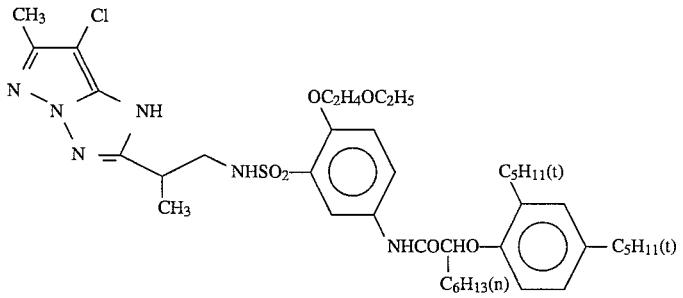

-continued
(M-32)
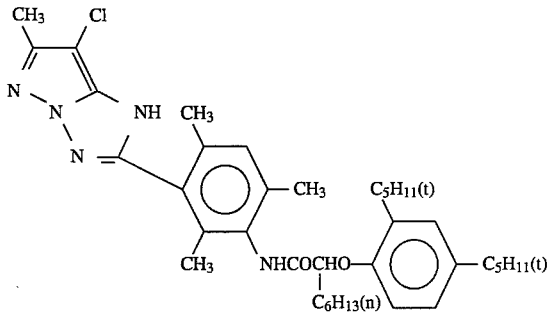
(M-33)
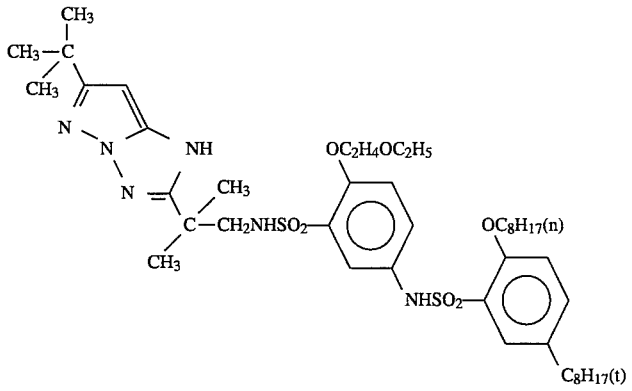
(M-34)
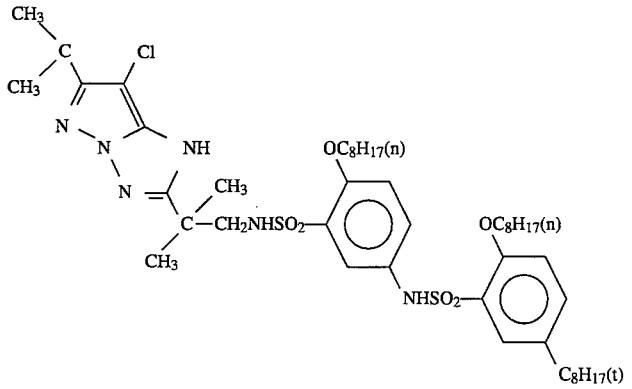
(M-35)
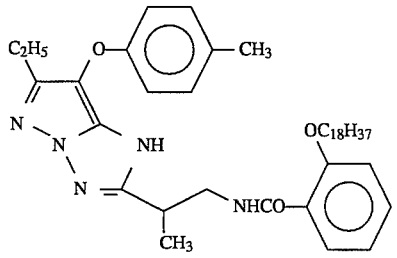
(M-36)
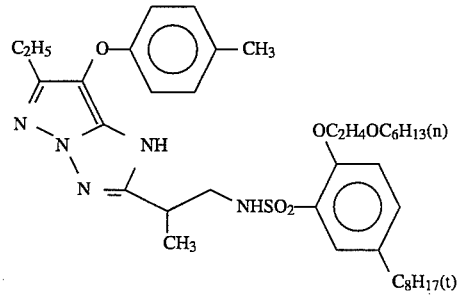

-continued
(M-37)
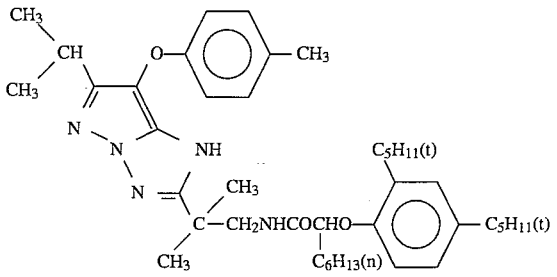
(M-38)
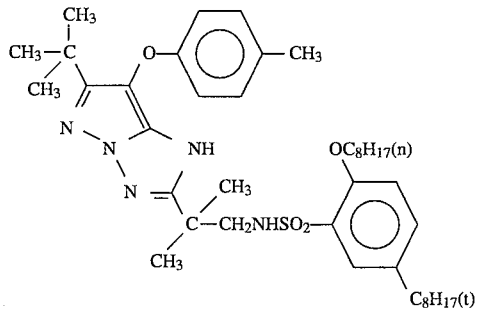
(M-39)
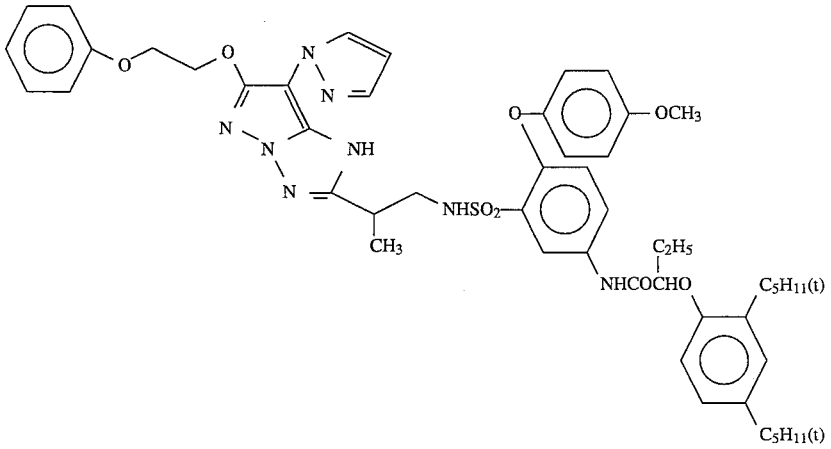
(M-40)
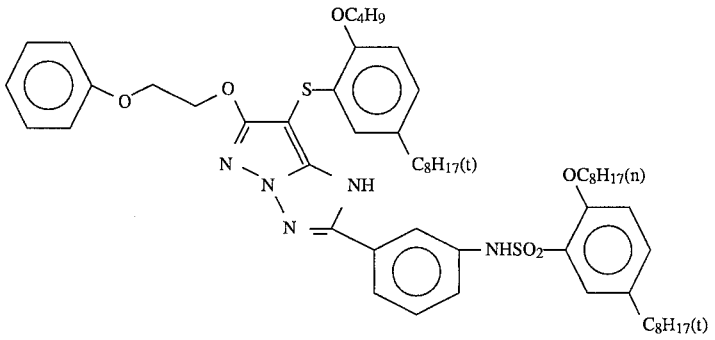

-continued
(M-41)
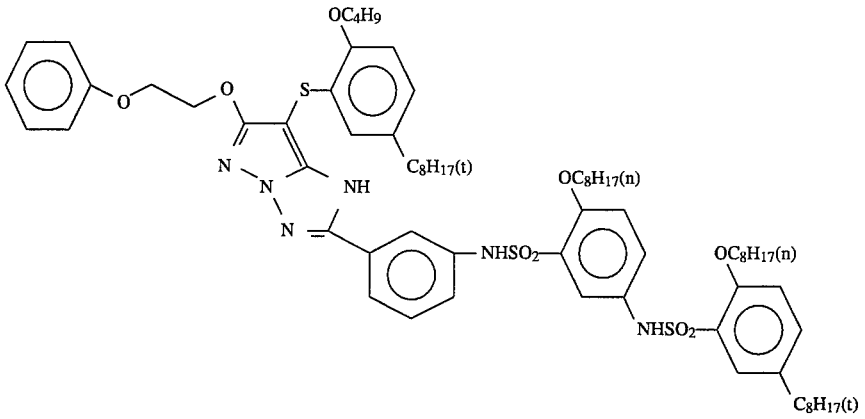
(M-42)
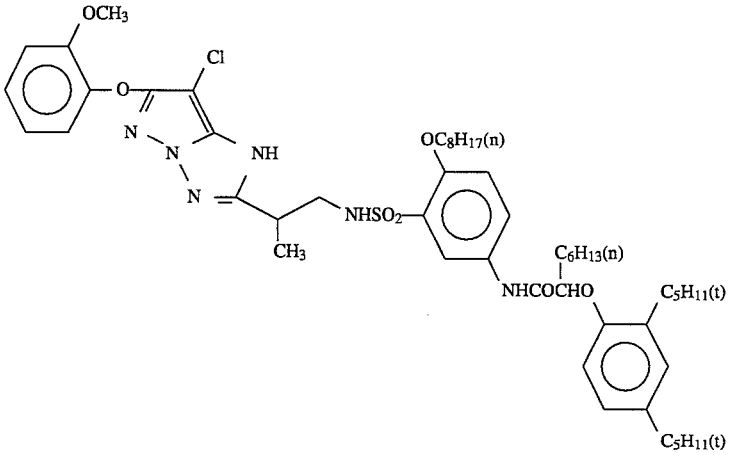
(M-43)
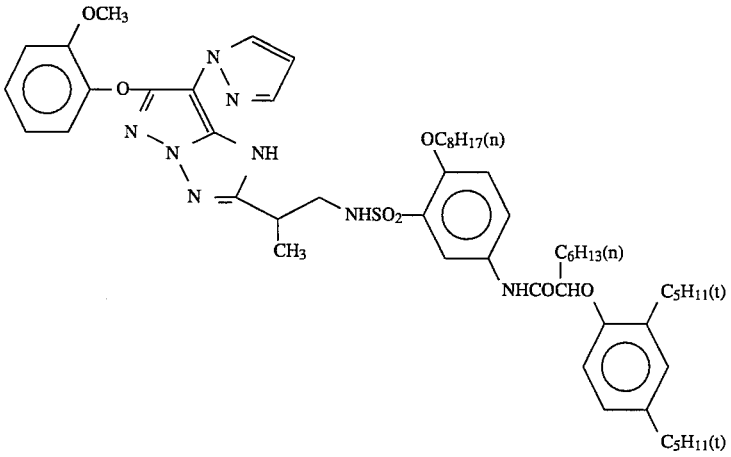

-continued
(M-44)
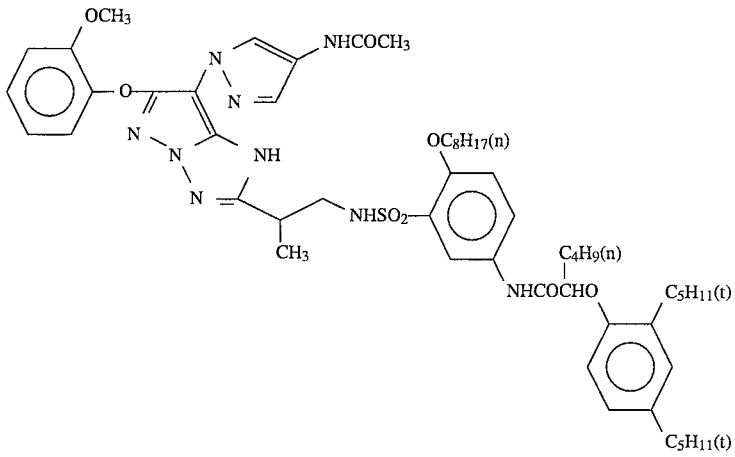
(M-45)
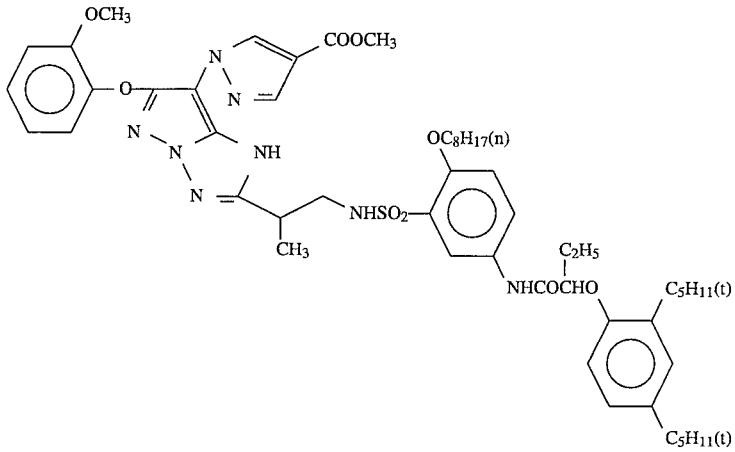
(M-46)
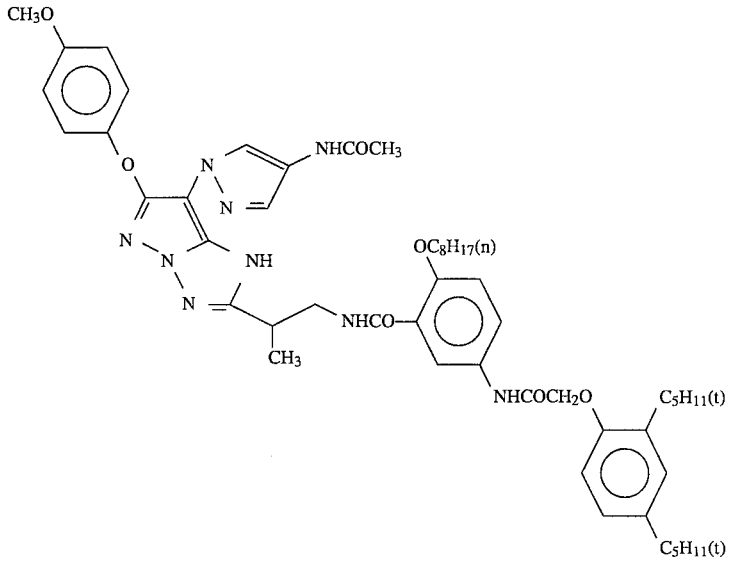

-continued
(M-47)
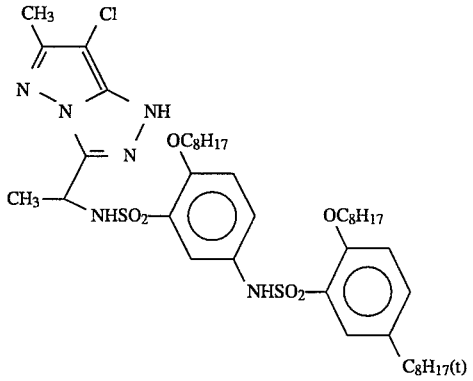
(M-48)
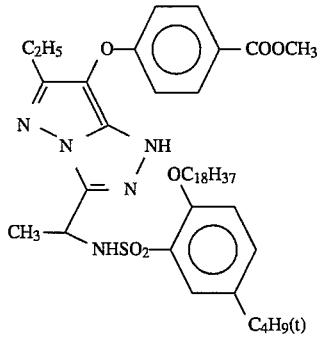
(M-49)
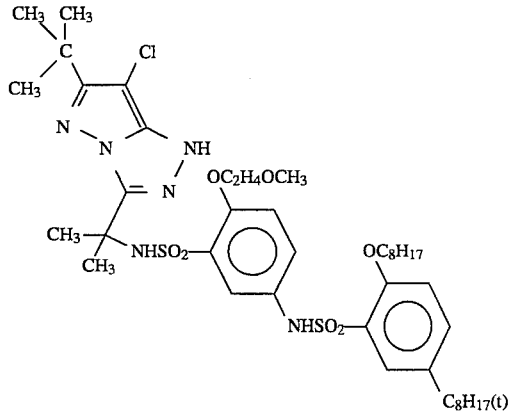
(M-50)
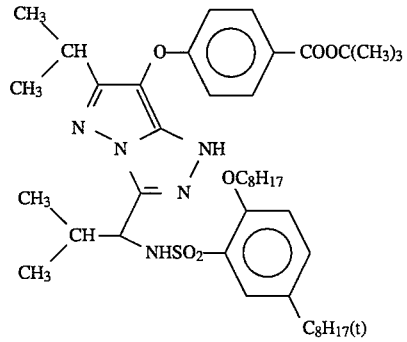

-continued
(M-51)
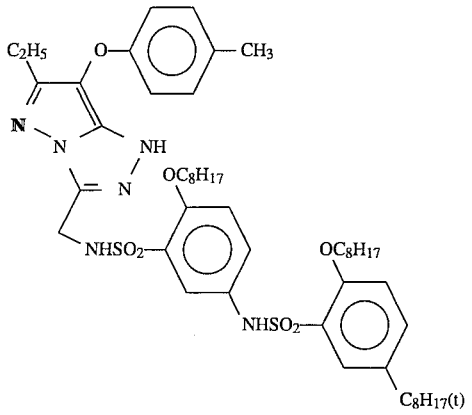
(M-52)
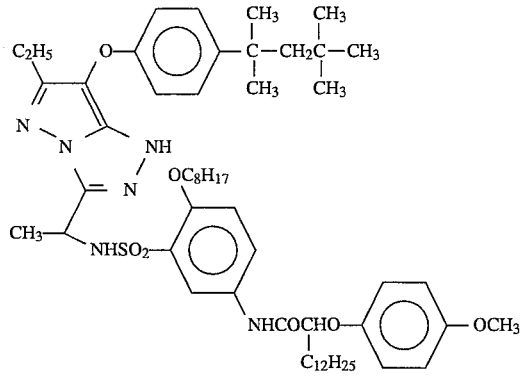
(M-53)
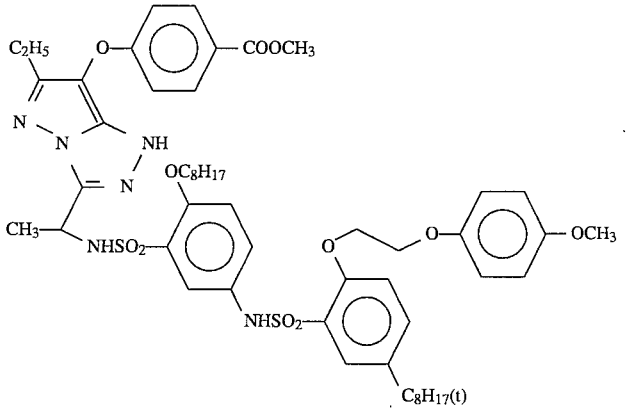
(M-54)
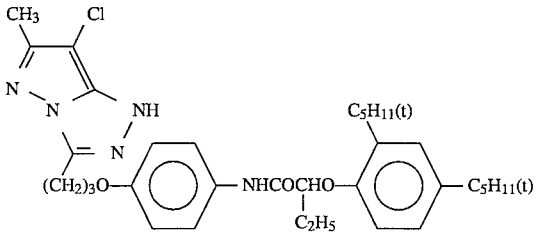

-continued
(M-55)
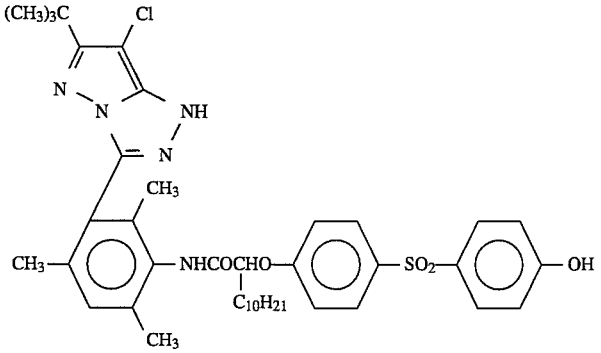
(M-56)
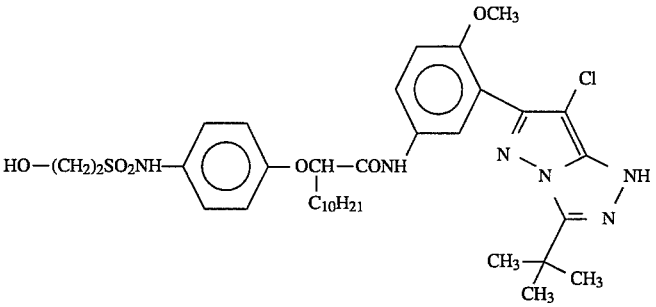
(M-57)
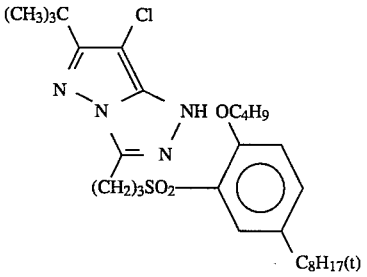
(M-58)
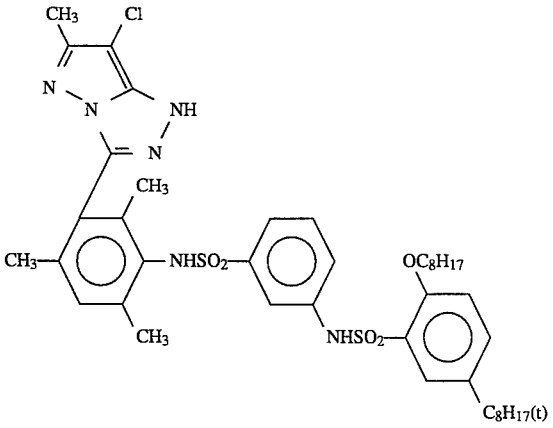

-continued
(M-59)
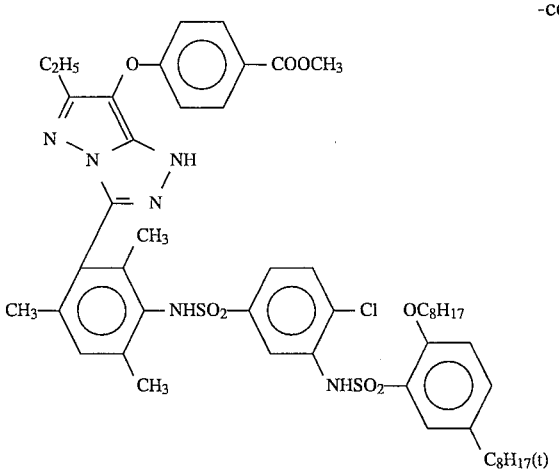
(M-60)
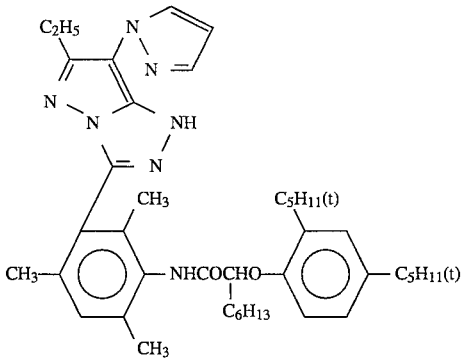
(M-61)
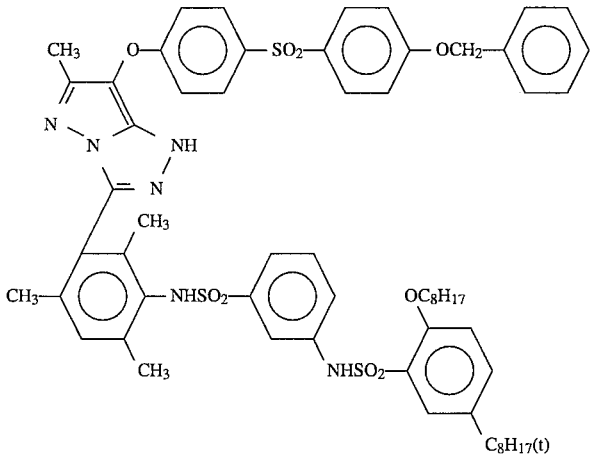

-continued
(M-62)
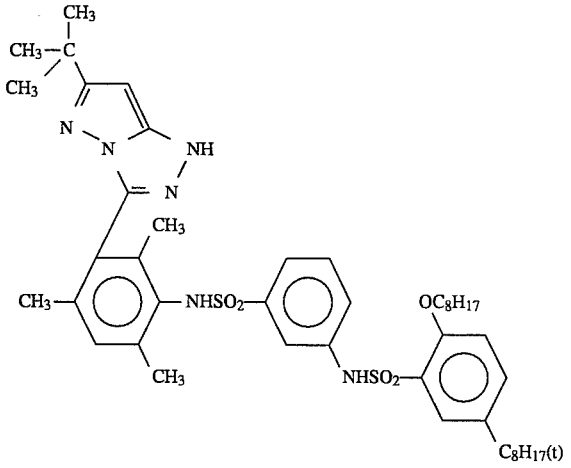
(M-63)
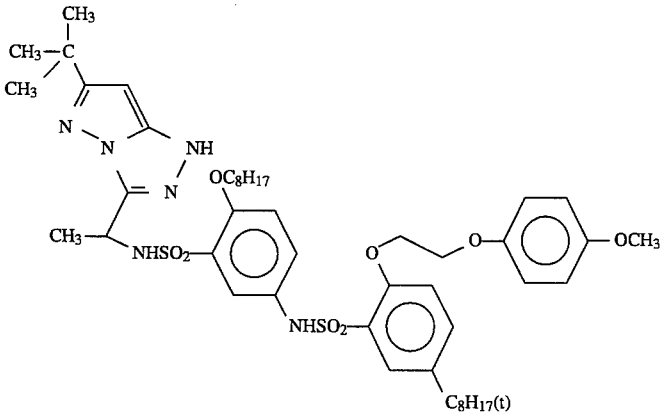
(M-64)
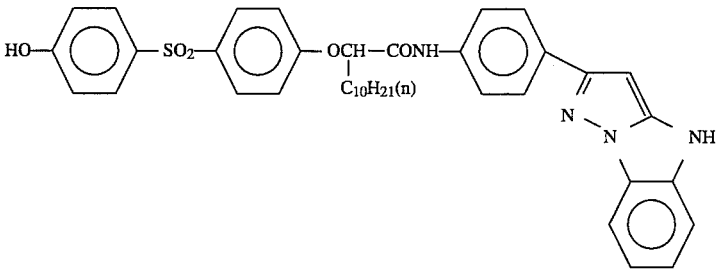
(M-65)
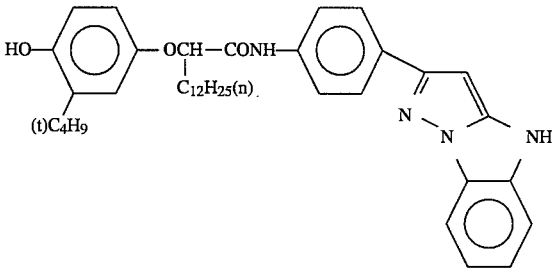

-continued
(M-66)
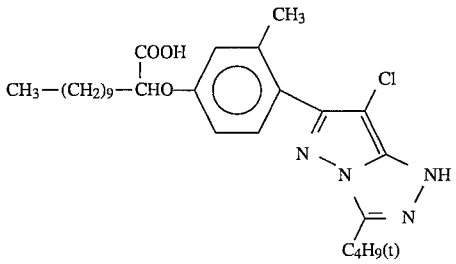
(M-67)
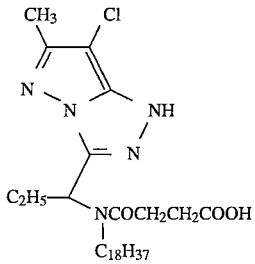
(M-68)
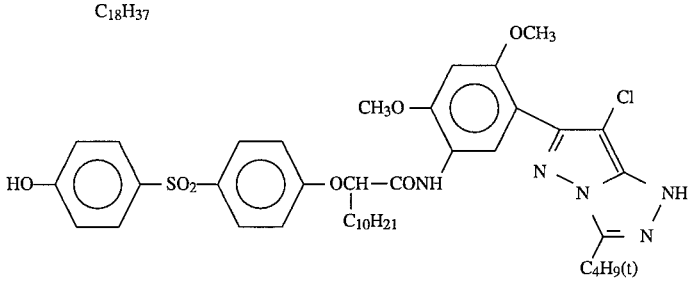
(M-69)
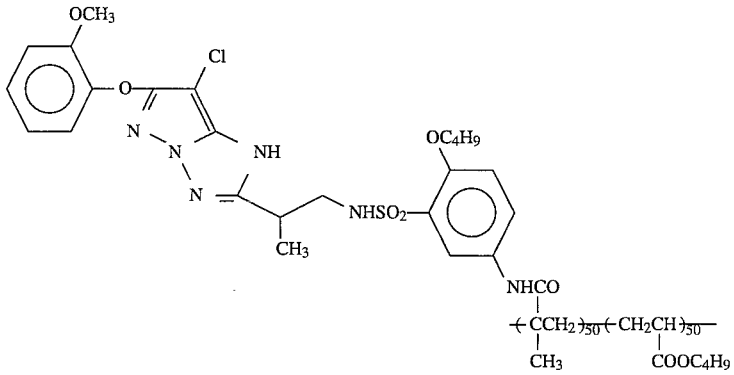
(subscript figures: ratio of monomers constituting copolymer (weight ratio))
(M-70)
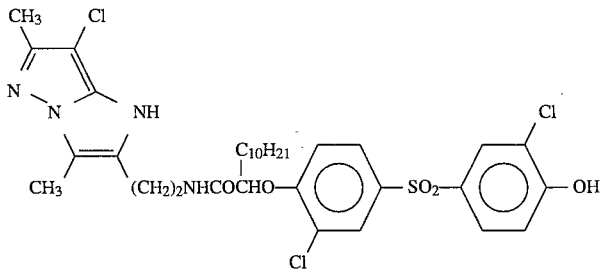

-continued (M-71)

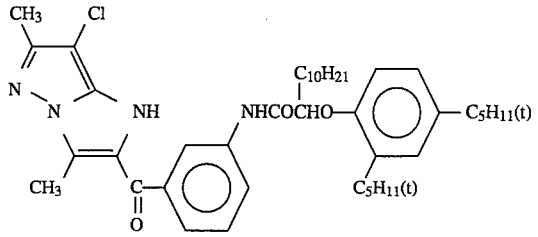

(M-72)

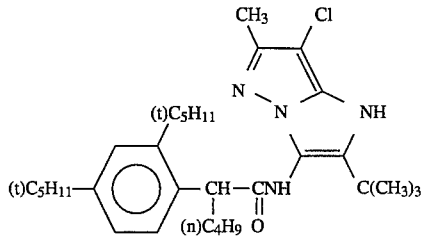

(M-73)

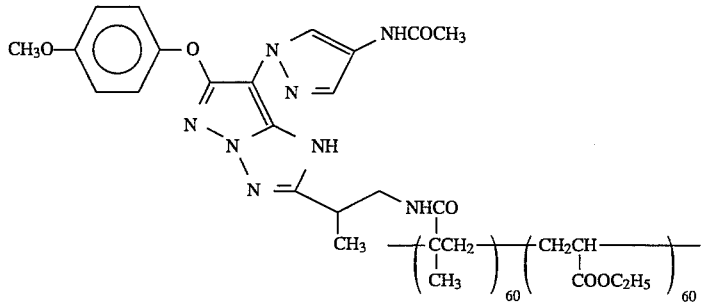

(subscript figures: ratio of monomers constituting copolymer (weight ratio))

(M-74)

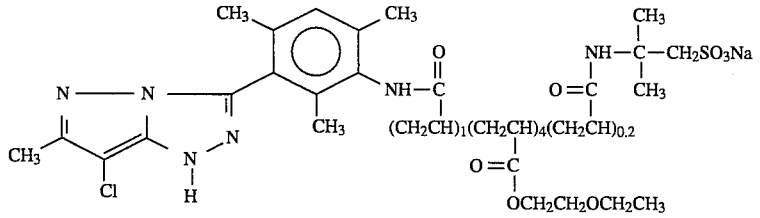

(subscript figures: ratio of monomers constituting copolymer (weight ratio))

The couplers represented by the foregoing formula (M) can be synthesized according to the methods as described in the references cited below.

Specifically, there can be adopted the method as described, e.g., in U.S. Pat. No. 4,500,630 in synthesizing the compounds of the foregoing formula (M-I), the methods as described, e.g., in U.S. Pat. Nos. 4,540,654 and 4,705,863, JP-A-61-65245, JP-A-62-209457 and JP-A-62-249155 in synthesizing the compounds of formula (M-II), the methods as described, e.g., in JP-B-47-27411 and U.S. Pat. No. 3,725,067 in synthesizing the compounds of formula (M-III), and the methods as described, e.g., in JP-A-60-33552 in synthesizing the compounds of formula (M-IV).

The magenta coupler of the formula (M) according to the present invention is incorporated in a green-sensitive emulsion layer and/or a layer adjacent thereto. The total amount of the magenta coupler incorporated is in the range of 0.01 to 1.5 g/m$^2$, preferably 0.05 to 1.0 g/m$^2$, and more preferably 0.1 to 0.8 g/m$^2$. Methods usable for incorporating the magenta coupler into the photographic material are the same as those described hereinafter for incorporation of other couplers. Therein, the ratio of a high boiling organic solvent used as dispersing solvent to the whole couplers in the magenta coupler-containing layer ranges from 0 to 10.0 by weight, preferably from 0 to 3.0 by weight, and more preferably from 0.1 to 1.5 by weight.

For the purpose of improvements in color forming ability and processing dependence, the compound represented by the formula (SO) of the present invention is used as high boiling organic solvent.

As various arts and inorganic and organic ingredients for the silver halide photographic emulsion according to the present invention, and the silver halide color photographic material comprising the emulsion, those described in *Research Disclosure* No. 308119 (1989) can generally be used.

More specifically, the arts and inorganic and organic ingredients applicable to the color photographic material comprising the silver halide photographic emulsion according to the present invention are described in the following sections of EP-A-0436938 and in the patents recited below.

| Item | Corresponding Section |
|---|---|
| 1) Layer structure | p. 146, l. 34, to p. 147, l. 25 |
| 2) Silver halide emulsions | p. 147, l. 26, to p. 148, l. 12 |
| 3) Yellow couplers | p. 137, l. 35, to p. 146, l. 33 and p. 149, l. 21 to l. 23 |
| 4) Magenta couplers usable together with ones represented by the formula (M) | p. 149, l. 24 to l. 28; EP-A-0421453, p. 3, l. 5, to p. 25, l. 55 |
| 5) Cyan couplers | p. 149, l. 29 to l. 33; EP-A-0432804, p. 3, l. 28, to p. 40, l. 2 |
| 6) Polymer couplers | p. 149, l. 34 to l. 38; EP-A-0435334, p. 113, l. 39, to p. 123, l. 37 |
| 7) Colored couplers | p. 53, l. 42, to p. 137, l. 34, and p. 149, l. 39 to l. 45 |
| 8) Other functional couplers | p. 7, l. 1, to p. 53, l. 41, and p. 149, l. 46, to p. 150, l. 3; EP-A-0435334, p. 3, l. 1, to p. 29, l. 50 |
| 9) Antiseptics and antimolds | p. 150, l. 25 to l. 28 |
| 10) Formaldehyde scavengers | p. 149, l. 15 to l. 17 |
| 11) Other additives | p. 153, l. 38 to l. 47; EP-A-0421453, p. 75, l. 21, to p. 84, l. 56, and p. 27, l. 40, to p. 37, l. 40 |
| 12) Dispersing methods | p. 150, l. 4 to l. 24 |
| 13) Support | p. 150, l. 32 to l. 34 |
| 14) Film thickness and film properties | p. 150, l. 35 to l. 49 |
| 15) Color development, black-and-white development, and fogging steps | p. 150, l. 50, to p. 151, l. 47; EP-A-0442323, p. 34, l. 11 to l. 54, and p. 35, l. 14 to l. 22 |
| 16) Desilvering step | p. 151, l. 48, to p. 152, l. 53 |
| 17) Automatic developing machines | p. 152, l. 54, to p. 153, l. 2 |
| 18) Washing and stabilizing steps | p. 153, l. 3 to l. 37 |

The present invention will now be illustrated in more detail by reference to the following examples. However, the invention should not be construed as being limited to these examples.

EXAMPLE 1

The coupler M-2 according to the present invention was weighed out in an amount of 15.0 g, admixed with 7.5 g of tricresyl phosphate (Comparative Compound S-a) as a high boiling organic solvent and further dissolved in 25 ml of ethyl acetate. The resulting solution was dispersed in an emulsified condition into 200 g of a 8.5 wt% aqueous gelatin solution containing 1.5 g of sodium dodecylbenzenesulfonate.

The total amount of this emulsified dispersion was added to 250 g of a silver iodobromide emulsion (containing 70.0 g of silver per Kg of emulsion and having a silver iodide content of 2.5 mole%), and coated on a triacetate film base provided with a subbing layer at a silver coverage of 0.80 g/m$^2$. On the coated layer was provided a gelatin layer as protective layer in a dry thickness of 2.0 μm. Thus, Sample No. 101 was prepared. Additionally, the gelatin hardener used therein was 1,2-bis (vinylsulfonylacetamido)ethane.

Further, Sample Nos. 102 to 114 were prepared in the same manner as Sample No. 101, except that the high boiling organic solvent was replaced by those shown in Table 1 respectively.

The thus prepared samples were each exposed to white light through an optical wedge, and subjected to the photographic processing illustrated below:

| Processing Step | Time | Temperature |
|---|---|---|
| First development | 6 min. | 38° C. |
| Washing | 2 min. | 38° C. |
| Reversal | 2 min. | 38° C. |
| Color development | 6 min. | 38° C. |
| Pre-bleaching | 2 min. | 38° C. |
| Bleaching | 6 min. | 38° C. |
| Fixation | 4 min. | 38° C. |
| Washing | 4 min. | 38° C. |
| Final rinsing | 1 min. | 25° C. |

Compositions of the processing solutions used in the above-described steps respectively are as follows:

| First Developer | |
|---|---|
| Pentasodium nitrilo-N,N,N-trimethylenephosphonate | 1.5 g |
| Pentasodium diethylenetriaminepentaacetate | 2.0 g |
| Sodium sulfite | 30 g |
| Potassium hydroquinonemonosulfonate | 20 g |
| Potassium carbonate | 15 g |
| Potassium hydrogen carbonate | 12 g |
| 1-Phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethylene glycol | 13 g |
| Water to make | 1,000 ml |
| pH | 9.60 |

The pH was adjusted with sulfuric acid or potassium hydroxide.

| Reversing Solution | |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1,000 ml |
| pH | 6.00 |

The pH was adjusted with acetic acid or sodium hydroxide.

| Color Developer | |
|---|---|
| Pentasodium nitrilo-N,N,N-trimethylenephosphonate | 2.0 g |
| Sodium sulfite | 7.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-Ethyl-N-(β-methanesulfonamidoethyl)-3-methyl-4-aminoaniline.3/2 sulfate.monohydrate | 11 g |

-continued

| Color Developer | |
|---|---|
| 3,6-Dithiaoctane-1,8-diol | 1.0 g |
| Water to make | 1,000 ml |
| pH | 11.80 |

The pH was adjusted with sulfuric acid or potassium hydroxide.

| Pre-bleaching Solution | |
|---|---|
| Disodium ethylenediaminetetraacetate dihydrate | 8.0 g |
| Sodium sulfite | 6.0 g |
| 1-Thioglycerol | 0.4 g |
| Formaldehyde-sodium bisulfite adduct | 30 g |
| Water to make | 1,000 ml |
| pH | 6.20 |

The pH was adjusted with acetic acid or sodium hydroxide.

| Bleaching Solution | |
|---|---|
| Disodium ethylenediaminetetraacetate dihydrate | 2.0 g |
| Ammonium ethylenediaminetetraacetato-ferrate(III) dihydrate | 120 g |
| Potassium bromide | 100 g |
| Ammonium nitrate | 10 g |
| Water to make | 1,000 ml |
| pH | 5.70 |

The pH was adjusted with nitric acid or sodium hydroxide.

| Fixing Solution | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |

The pH was adjusted with acetic acid or aqueous ammonia.

| Final Rinsing Solution | |
|---|---|
| 1,2-Benzoisothiazoline-3-one | 0.02 g |
| Polyoxyethylene-p-monononylphenylether (average polymerization degree: 10) | 0.3 g |
| Polymaleic acid (average molecular weight: 2,000) | 0.1 g |
| Water to make | 1,000 ml |
| pH | 7.0 |

The processed samples each underwent the density measurement through a green filter, and thereby examined for the maximum density (Dmax) of developed magenta color. The results obtained are shown in Table 1.

TABLE 1

| Sample No. | High Boiling Organic Solvent | Dmax of Developed Magenta Color | Note |
|---|---|---|---|
| 101 | Comparative Compound S-a | 1.93 | Comparison |
| 102 | Comparative Compound S-b | 2.02 | " |
| 103 | Comparative Compound S-c | 1.90 | " |
| 104 | Comparative Compound S-d | 1.60 | " |
| 105 | SO-1 | 2.42 | Invention |
| 106 | SO-4 | 2.40 | " |
| 107 | SO-5 | 2.40 | " |
| 108 | SO-6 | 2.38 | " |
| 109 | SO-13 | 2.36 | " |
| 110 | SO-18 | 2.38 | " |
| 111 | SO-27 | 2.35 | " |
| 112 | SO-31 | 2.44 | " |
| 113 | SO-37 | 2.41 | " |
| 114 | SO-45 | 2.43 | " |

Comparative Compound S-a

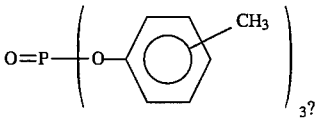

Comparative Compound S-b $CH_3(CH_2)_7CH{=}CH(CH_2)_8OH$

Comparative Compound S-c (i)$C_{18}H_{37}OCH(CH_3)CH_2OH$?

Comparative Compound S-d (i)$C_{18}H_{37}COOCH(OH)CH_2CH_3$?

As can be seen from Table 1, the density of developed magenta color was heightened by the use of the high boiling organic solvents relating to the present invention. It is an unexpected result that the high boiling organic solvents according to the present invention enables considerably high color generation, compared with the comparative compounds of alcohol type, S-b and S-c. This result proves the specificity of the compounds according to the present invention.

EXAMPLE 2

On a 127 μm-thick cellulose triacetate film support provided with a subbing layer, layers having the following compositions respectively were coated to prepare a multilayer color photographic material (Sample No. 201). Each figure on the right side designates the coverage (g/m$^2$) of the ingredient corresponding thereto. Additionally, effects of each ingredient should not be construed as being limited to the designated use thereof.

| First layer: Antihalation layer | |
|---|---|
| Black colloidal silver | 0.20 g |
| Gelatin | 1.90 g |
| Ultraviolet absorbent U-1 | 0.10 g |
| Ultraviolet absorbent U-3 | 0.040 g |
| Ultraviolet absorbent U-4 | 0.10 g |
| High boiling organic solvent Oil-1 | 0.10 g |

-continued

| | |
|---|---|
| Microcrystalline solid dispersion of Dye E-1 | 0.10 g |

Second layer: Interlayer

| | |
|---|---|
| Gelatin | 0.40 g |
| Compound Cpd-C | 5.0 mg |
| Compound Cpd-J | 5.0 mg |
| Compound Cpd-K | 3.0 mg |
| High boiling organic solvent Oil-3 | 0.10 g |
| Dye D-4 | 0.80 mg |

Third layer: Interlayer

| | |
|---|---|
| Fine grain silver iodobromide emulsion fogged inside and at the surface of the grains (average grain size: 0.06 μm, variation coefficient: 18%, silver iodide content: 1 mole %) | 0.050 g, based on Ag |
| Yellow colloidal silver | 0.030 g, based on Ag |
| Gelatin | 0.40 g |

Fourth layer: Low-speed red-sensitive emulsion layer

| | |
|---|---|
| Emulsion A | 0.30 g, based on Ag |
| Emulsion B | 0.20 g, based on Ag |
| Gelatin | 0.80 g |
| Coupler C-1 | 0.15 g |
| Coupler C-2 | 0.050 g |
| Coupler C-3 | 0.050 g |
| Coupler C-8 | 0.050 g |
| Compound Cpd-C | 5.0 mg |
| Compound Cpd-J | 5.0 mg |
| High boiling organic solvent Oil-2 | 0.10 g |
| Additive P-1 | 0.10 g |

Fifth layer: Medium-speed red-sensitive emulsion layer

| | |
|---|---|
| Emulsion B | 0.20 g, based on Ag |
| Emulsion C | 0.30 g, based on Ag |
| Gelatin | 0.80 g |
| Coupler C-1 | 0.20 g |
| Coupler C-2 | 0.050 g |
| Coupler C-3 | 0.20 g |
| High boiling organic solvent Oil-2 | 0.10 g |
| Additive P-1 | 0.10 g |

Sixth layer: High speed red-sensitive emulsion layer

| | |
|---|---|
| Emulsion D | 0.40 g, based on Ag |
| Gelatin | 1.10 g |
| Coupler C-1 | 0.30 g |
| Coupler C-2 | 0.10 g |
| Coupler C-3 | 0.70 g |
| Additive P-1 | 0.10 g |

Seventh layer: Interlayer

| | |
|---|---|
| Gelatin | 0.60 g |
| Additive P-2 | 0.30 g |
| Color mixture preventive Cpd-I | 2.6 mg |
| Dye D-5 | 0.020 g |
| Dye D-6 | 0.010 g |
| Compound Cpd-J | 5.0 mg |
| High boiling organic solvent Oil-1 | 0.020 g |

Eighth layer: Interlayer

| | |
|---|---|
| Fine grain silver iodobromide emulsion fogged inside and at the surface of the grains (average grain size: 0.06 μm, variation coefficient: 16%, silver iodide content: 0.3 mole %) | 0.020 g, based on Ag |
| Yellow colloidal silver | 0.020 g, based on Ag |
| Gelatin | 1.00 g |
| Additive P-1 | 0.20 g |
| Color mixture preventive Cpd-A | 0.10 g |
| Compound Cpd-C | 0.10 g |

Ninth layer: Low-speed green-sensitive emulsion layer

| | |
|---|---|
| Emulsion E | 0.10 g, based on Ag |

-continued

| | |
|---|---|
| Emulsion F | 0.20 g, based on Ag |
| Emulsion G | 0.20 g, based on Ag |
| Gelatin | 0.50 g |
| Coupler C-4 | 0.20 g |
| Coupler C-7 | 0.050 g |
| Compound Cpd-B | 0.030 g |
| Compound Cpd-D | 0.020 g |
| Compound Cpd-E | 0.020 g |
| Compound Cpd-F | 0.040 g |
| Compound Cpd-J | 10 mg |
| Compound Cpd-L | 0.020 g |
| High boiling organic solvent Oil-1 (Comparative compound S-a) | 0.18 g |

Tenth layer: Medium-speed green-sensitive emulsion layer

| | |
|---|---|
| Emulsion G | 0.30 g, based on Ag |
| Emulsion H | 0.10 g, based on Ag |
| Gelatin | 0.60 g |
| Coupler C-4 | 0.15 g |
| Coupler C-7 | 0.05 g |
| Compound Cpd-B | 0.030 g |
| Compound Cpd-D | 0.020 g |
| Compound Cpd-E | 0.020 g |
| Compound Cpd-F | 0.050 g |
| Compound Cpd-L | 0.050 g |
| High boiling organic solvent Oil-1 (Comparative compound S-a) | 0.15 g |

Eleventh layer: High-speed green-sensitive emulsion layer

| | |
|---|---|
| Emulsion I | 0.50 g, based on Ag |
| Gelatin | 1.00 g |
| Coupler C-4 | 0.31 g |
| Coupler C-7 | 0.10 g |
| Compound Cpd-B | 0.080 g |
| Compound Cpd-E | 0.020 g |
| Compound Cpd-F | 0.040 g |
| Compound Cpd-K | 5.0 mg |
| Compound Cpd-L | 0.020 g |
| High boiling organic solvent Oil-1 (Comparative compound S-a) | 0.31 g |

Twelfth layer: Interlayer

| | |
|---|---|
| Gelatin | 0.60 g |
| Compound Cpd-L | 0.050 g |
| High boiling organic solvent Oil-1 | 0.050 g |

Thirteenth layer: Yellow filter layer

| | |
|---|---|
| Yellow colloidal silver | 0.070 g, based on Ag |
| Gelatin | 1.10 g |
| Color mixture preventive Cpd-A | 0.010 g |
| Compound Cpd-L | 0.010 g |
| High boiling organic solvent Oil-1 | 0.010 g |
| Microcrystalline solid dispersion of Dye E-2 | 0.050 g |

Fourteenth layer: Interlayer

| | |
|---|---|
| Gelatin | 0.60 g |

Fifteenth layer: Low-speed blue-sensitive emulsion layer

| | |
|---|---|
| Emulsion J | 0.20 g, based on Ag |
| Emulsion K | 0.30 g, based on Ag |
| Gelatin | 0.80 g |
| Coupler C-5 | 0.20 g |
| Coupler C-6 | 0.10 g |
| Coupler C-9 | 0.40 g |

Sixteenth layer: Medium-speed blue-sensitive emulsion layer

| | |
|---|---|
| Emulsion L | 0.30 g, based on Ag |
| Emulsion M | 0.30 g, based on Ag |
| Gelatin | 0.90 g |

-continued

| | |
|---|---|
| Coupler C-5 | 0.10 g |
| Coupler C-6 | 0.10 g |
| Coupler C-9 | 0.60 g |
| Seventeenth layer: High-speed blue-sensitive emulsion layer | |
| Emulsion N | 0.20 g, based on Ag |
| Emulsion O | 0.20 g, based on Ag |
| Gelatin | 1.20 g |
| Coupler C-5 | 0.10 g |
| Coupler C-6 | 0.10 g |
| Coupler C-9 | 0.60 g |
| High boiling organic solvent Oil-2 | 0.10 g |

-continued

| | |
|---|---|
| Eighteenth layer: First protective layer | |
| Gelatin | 0.70 g |
| Ultraviolet absorbent U-1 | 0.20 g |
| Ultraviolet absorbent U-2 | 0.050 g |
| Ultraviolet absorbent U-5 | 0.30 g |
| Formaldehyde scavenger Cpd-H | 0.40 g |
| Dye D-1 | 0.15 g |
| Dye D-2 | 0.050 g |
| Dye D-3 | 0.10 g |
| Nineteenth layer: Second protective layer | |
| Colloidal silver | 0.10 mg, based on Ag |
| Fine grain silver iodobromide emulsion (average grain size: 0.06 μm, silver iodide content: 1 mole %) | 0.10 g, based on Ag |
| Gelatin | 0.40 g |
| Twentieth layer: Third protective layer | |
| Gelatin | 0.40 g |
| Polymethylmethacrylate (average particle size: 1.5 μm) | 0.10 g |
| Methylmethacrylate-acrylic acid (4:6) copolymer (average particle size: 1.5 μm) | 0.10 g |
| Silicone oil | 0.030 g |
| Surfactant W-1 | 3.0 mg |
| Surfactant W-2 | 0.030 g |

In addition to the above-described ingredients, additives F-1 to F-8 were added to every emulsion layer. Further, a gelatin hardener H-1 and surfactants W-3, W-4, W-5 and W-6 as coating aid were added to each layer.

Furthermore, phenol, 1,2-benzisothiazoline-3-one, 2-phenoxyethanol, phenetyl alcohol and butyl ester of p-benzoic acid were added as antiseptic and antimold.

Characteristics of the silver iodobromide emulsions used in Sample No. 201 are set forth in Table 2.

TABLE 2

| Emulsion Name | Features of Grains | Average grain diameter (μm) determined supposing that the grains are spherical | Variation Coefficient (%) | Silver Iodide Content (%) |
|---|---|---|---|---|
| A | Monodisperse tetradecahedral grains | 0.28 | 16 | 4.0 |
| B | Monodisperse cubic grains having internal latent image | 0.30 | 10 | 4.0 |
| C | Monodisperse cubic grains | 0.38 | 10 | 5.0 |
| D | Monodisperse tabular grains (average aspect ratio: 3.0) | 0.68 | 8 | 2.0 |
| E | Monodisperse cubic grains | 0.20 | 17 | 4.0 |
| F | Monodisperse tetradecahedral grains | 0.25 | 16 | 4.0 |
| G | Monodisperse cubic grains having internal latent image | 0.40 | 11 | 4.0 |
| H | Monodisperse cubic grains | 0.50 | 9 | 3.5 |
| I | Monodisperse tabular grains (average aspect ratio: 5.0) | 0.80 | 10 | 2.0 |
| J | Monodisperse cubic grains | 0.30 | 18 | 4.0 |
| K | Monodisperse tetradecahedral grains | 0.45 | 17 | 4.0 |
| L | Monodisperse tabular grains (average aspect ratio: 5.0) | 0.55 | 10 | 2.0 |
| M | Monodisperse tabular grains (average aspect ratio: 8.0) | 0.70 | 13 | 2.0 |
| N | Monodisperse tabular grains (average aspect ratio: 6.0) | 1.00 | 10 | 1.5 |
| O | Monodisperse tabular grains (average aspect ratio: 9.0) | 1.20 | 15 | 1.5 |

Sensitizing dyes used for spectrally sensitizing the emulsions are set forth in Table 3 and Table 4.

TABLE 3

| Emulsion Name | Sensitizing Dyes used | Amount (g) of Each Dye added per mole of Silver Halide |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |

TABLE 3-continued

| Emulsion Name | Sensitizing Dyes used | Amount (g) of Each Dye added per mole of Silver Halide |
|---|---|---|
| | S-5 | 0.08 |
| | S-9 | 0.05 |
| H | S-4 | 0.20 |
| | S-5 | 0.060 |
| | S-9 | 0.050 |

TABLE 3-continued

| Emulsion Name | Sensitizing Dyes used | Amount (g) of Each Dye added per mole of Silver Halide |
|---|---|---|
| I | S-4 | 0.30 |
| | S-5 | 0.070 |
| | S-9 | 0.10 |

TABLE 4

| Emulsion Name | Sensitizing Dyes used | Amount (g) of Each Dye added per mole of Silver Halide |
|---|---|---|
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.015 |
| O | S-6 | 0.060 |
| | S-7 | 0.22 |

C-1

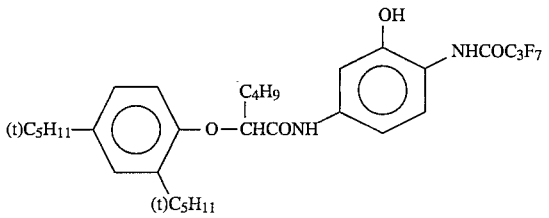

C-2

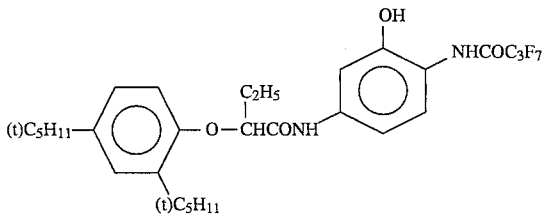

C-3

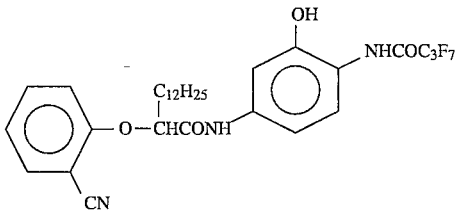

C-4

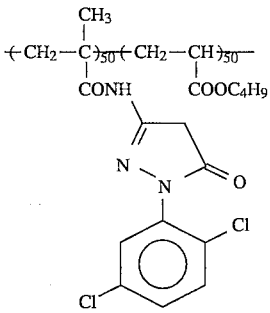

subscript figures: wt %
average molecular
weight: about 25,000

TABLE 4-continued
C-5
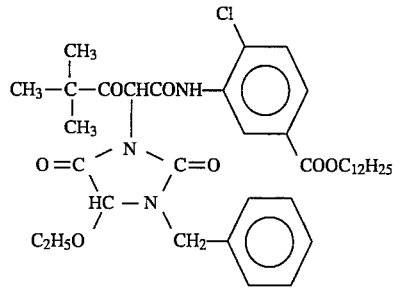
C-6
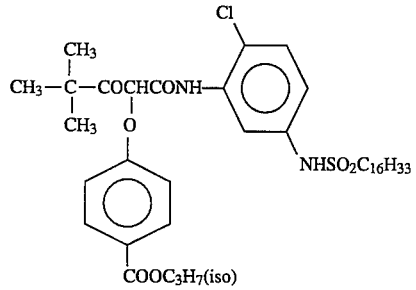
C-7
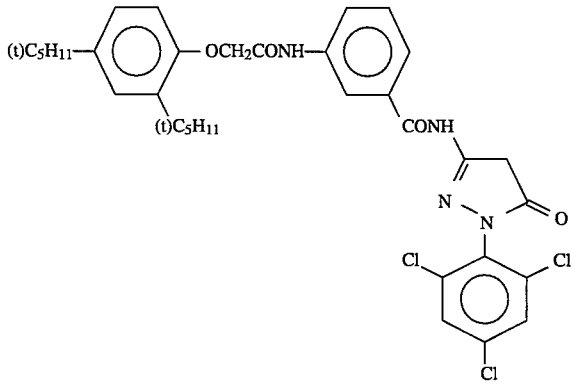
C-8
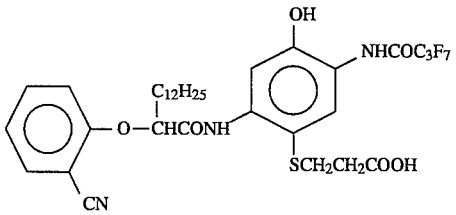
C-9
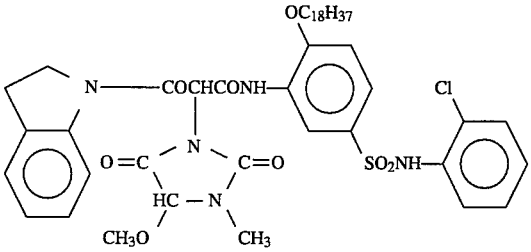
Oil-1: Tricresyl phosphate
Oil-2: Dibutyl phthalate TABLE 4-continued
Oil-3
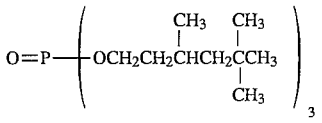
Cpd-A
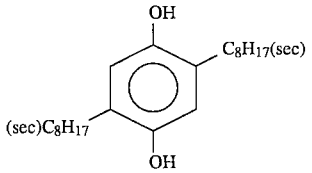
Cpd-B
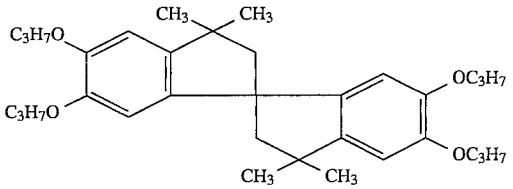
Cpd-C
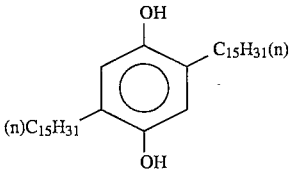
Cpd-D
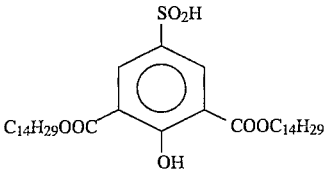
Cpd-E
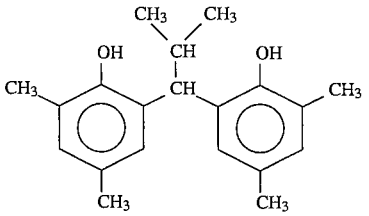
Cpd-F
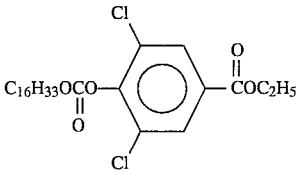
Cpd-H
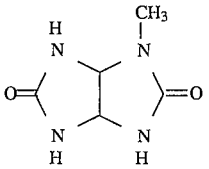

TABLE 4-continued
Cpd-I
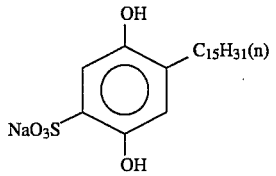
Cpd-J
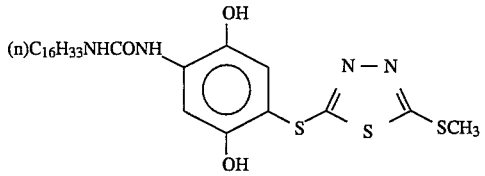
Cpd-K
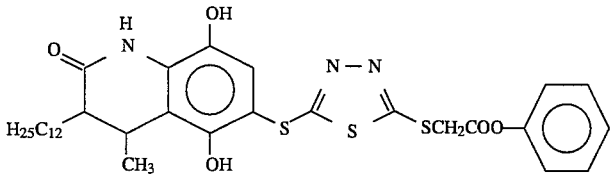
Cpd-L
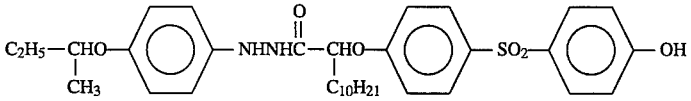
U-1
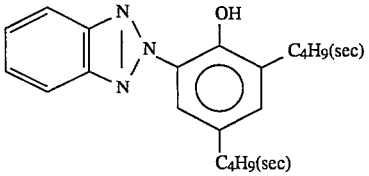
U-2
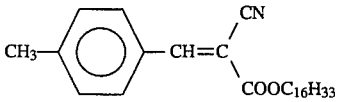
U-3
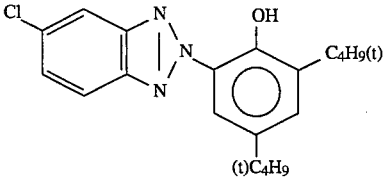
U-4
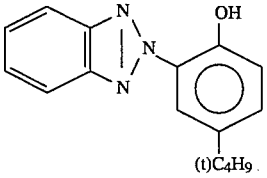
U-5
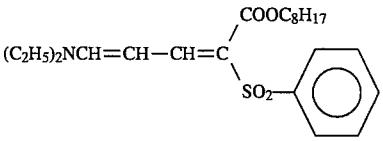
S-1
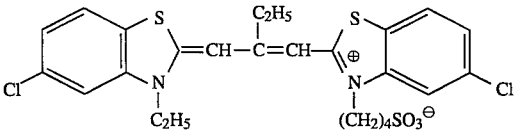

TABLE 4-continued
S-2
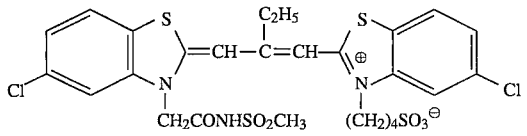
S-3
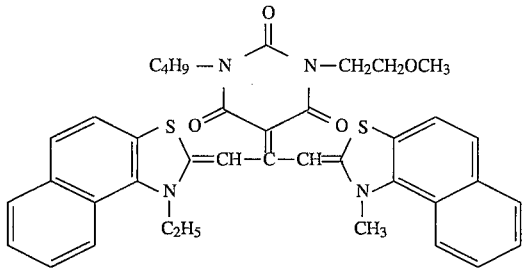
S-4
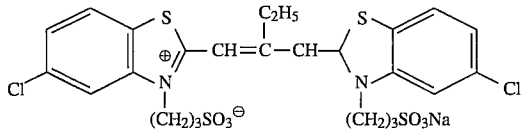
S-5
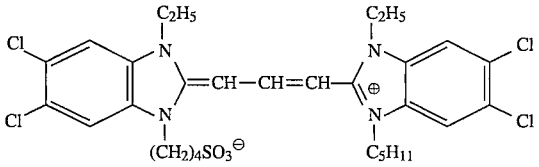
S-6
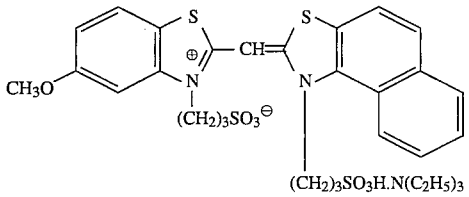
S-7
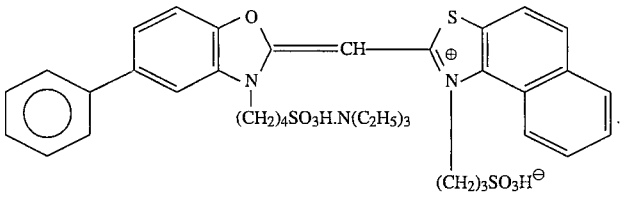
S-8
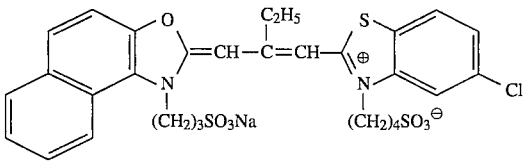
S-9
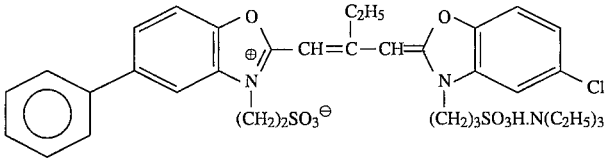

TABLE 4-continued
D-1
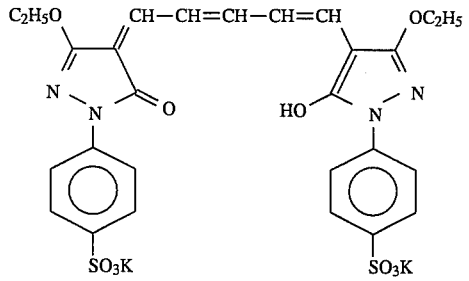
D-2
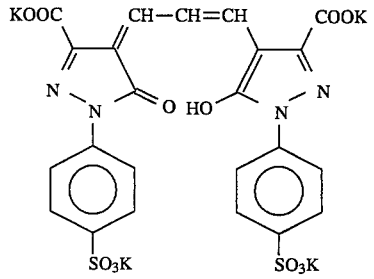
D-3
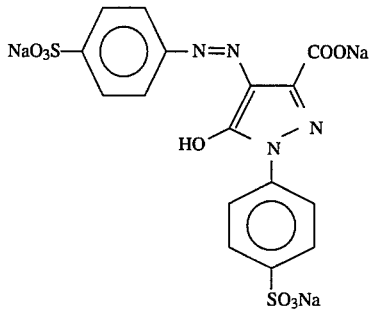
D-4
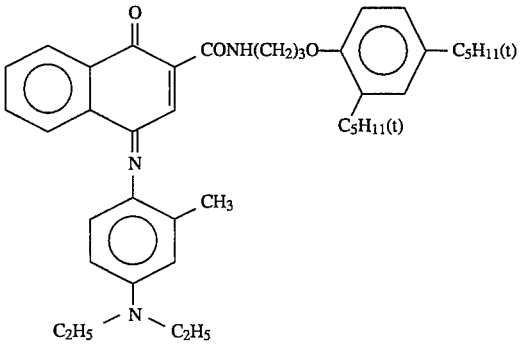
D-5
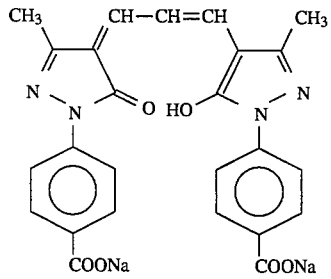

TABLE 4-continued
D-6
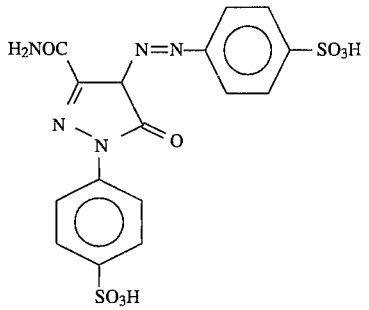
E-1
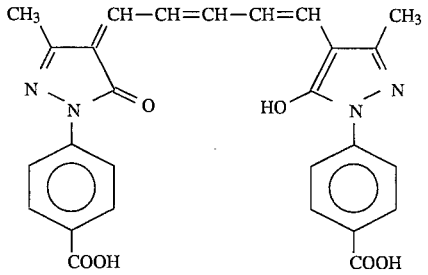
E-2
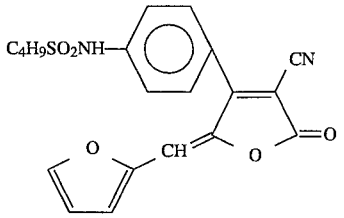
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
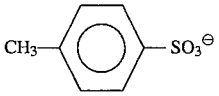
W-2
$C_8F_{17}SO_2\underset{\underset{C_3H_7}{|}}{C}NCH_2COOK$
W-3
$SaO_3S{-}\underset{\underset{CH_2COOCH_2CH(C_2H_5)C_4H_9}{|}}{CH}COOCH_2CH(C_2H_5)C_4H_9$
W-4
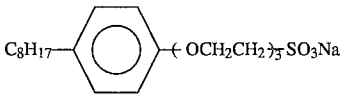
W-5
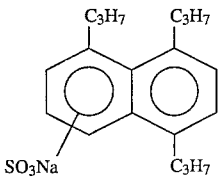
W-6
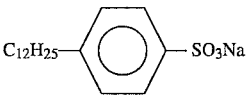

TABLE 4-continued
| | |
|---|---|
| P-1 | $\left(CH_2-\underset{\underset{CONHC_4H_9}{\vert}}{CH}\right)_n$ |
| P-2 | $\left(CH_2-\underset{\underset{COOC_4H_9}{\vert}}{CH}\right)_n$ |
| F-1 | 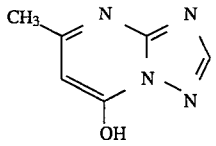 |
| F-2 | 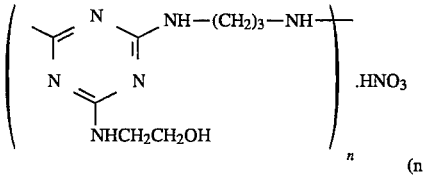 (n = 3~4) |
| F-3 | 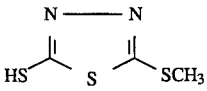 |
| F-4 | 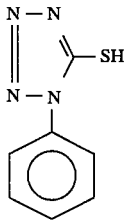 |
| F-5 | 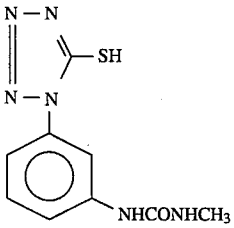 |
| F-6 | 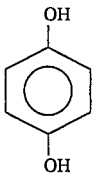 |
| F-7 | 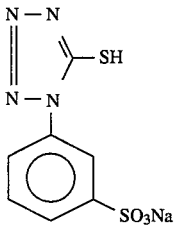 |

TABLE 4-continued

| | |
|---|---|
| F-8 | 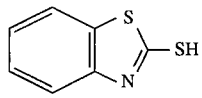 |

Further, Sample Nos. 202 to 212 were prepared in the same manner as Sample No. 201, except that the couplers C-4 and C-7 and the high boiling organic solvent Oil-1 contained in the ninth, tenth and eleventh layers were replaced as shown in Table 5.

In replacing the couplers and the high boiling organic solvents, the quantities thereof were changed so that the maximum density of magenta color developed in each sample by the photographic processing described in Example 1 (the density of the processed sample measured through a green filter) might be almost equal to that in Sample No. 201. Specifically, the coverage rates of the couplers and the high boiling organic solvents in Sample No. 202 for instance were 67% of those in Sample No. 201.

The thus prepared samples each was examined for processing dependence as follows.

Two filmstrips for each sample were prepared, and subjected to wedgewise exposure to white light. Then, one filmstrip for each sample was processed in the same manner as in Example 1. On the other hand, the other filmstrip for each sample was processed in the same manner as in Example 1, except that the quantity of the developing agent, N-ethyl-N-(β-methanesulfonamidoethyl)-3-methyl-4-aminoaniline·3/2 sulfate·monohydrate, in the color developer was reduced to 4.2 g.

The density measurements of the thus processed filmstrips were carried out, and the differential between the maximum densities of magenta images produced by the foregoing two kinds of photographic processing operations (ΔDmax) was taken as a measure of the processing dependence evaluation.

The results obtained are shown in Table 5.

As can be seen from Table 5, the processing dependence was improved by the use of the high boiling organic solvents according to the present invention.

Further, it has proved that although the magenta couplers relating to the present invention were considerably inferior in processing dependence when used in combination with conventional high boiling organic solvents, their processing dependence was greatly improved by the combined use with the high boiling organic solvents according to the present invention.

Additionally, color reproduction improved effects produced by the magenta couplers relating to the present invention were evaluated with photographs, and thereby was confirmed the effectiveness of those couplers.

More specifically, each of the foregoing samples was worked up into a 35 mm patrone form, and thereon were taken pictures. The object used therein was color checkers made by Macbeth Co., and the same photographic processing as adopted in Example 1 was performed.

Sensory evaluation of the thus processed photographs was practiced with respect to color reproduction (mainly reproduction of colors of red series), and thereby was confirmed the superiority of Sample Nos. 203 to 210 and 212 to Sample Nos. 201, 202 and 211.

EXAMPLE 3

Sample No. 301 was prepared in the same manner as the sample 106 in Example 1 of EP-A-0436938, except that Solv-1 and Solv-2 in the 7th, 8th and 9th layers were replaced by the high boiling organic solvent SO-1 according to the present invention in their respective equiweights.

TABLE 5

| Sample No. | Magenta Coupler 9th layer | Magenta Coupler 10th layer | Magenta Coupler 11th layer | High Boiling Organic Solvent (Ratio to Coupler) 9th layer | | 10th layer | | 11th layer | | ΔDmax | Note |
|---|---|---|---|---|---|---|---|---|---|---|---|
| 201 | C-4<br>C-7 | C-4<br>C-7 | C-4<br>C-7 | S-a | (0.75) | S-a | (0.75) | S-a | (0.75) | 0.26 | Comparison |
| 202 | C-4<br>C-7 | C-4<br>C-7 | C-4<br>C-7 | SO-1 | (0.75) | SO-1 | (0.75) | SO-1 | (0.75) | 0.19 | Invention |
| 203 | M-2 | M-2 | M-2 | S-a | (0.50) | S-a | (0.50) | S-a | (0.50) | 0.83 | Comparison |
| 204 | M-2 | M-2 | M-2 | S-b | (0.50) | S-b | (0.50) | S-b | (0.50) | 0.72 | Comparison |
| 205 | M-2 | M-2 | M-2 | S-c | (0.50) | S-c | (0.50) | S-c | (0.50) | 0.78 | Comparison |
| 206 | M-48 | M-48 | M-65 | S-b<br>SO-27 | (0.25)<br>(0.25) | S-b<br>SO-27 | (0.25)<br>(0.25) | SO-27 | (0.50) | 0.35 | Invention |
| 207 | M-2 | M-2 | M-2 | SO-1 | (0.50) | SO-1 | (0.50) | SO-1 | (0.50) | 0.26 | Invention |
| 208 | M-2 | M-26 | M-1 | SO-5<br>SO-37 | (0.25)<br>(0.25) | SO-5<br>SO-37 | (0.25)<br>(0.25) | SO-6<br>SO-45 | (0.25)<br>(0.25) | 0.38 | Invention |
| 209 | M-7 | M-21 | M-21 | SO-6 | (0.75) | SO-6 | (0.75) | SO-6 | (0.20) | 0.29 | Invention |
| 210 | M-3<br>M-6 | M-3<br>M-6 | M-3<br>M-6 | SO-4 | (0.10) | SO-4 | (0.10) | SO-4 | (0.50) | 0.42 | Invention |
| 211 | C-4<br>C-7 | C-4<br>C-7 | C-4<br>C-7 | SO-46 | (0.75) | SO-46 | (0.75) | SO-46 | (0.75) | 0.22 | Comparison |
| 212 | M-6 | M-33 | M-3 | SO-46 | (0.75) | SO-46 | (0.75) | SO-46 | (0.75) | 0.43 | Invention |

Sample No. 302, on the other hand, was prepared in the same manner as the sample recited above, except that the magenta couplers ExM-9, ExM-11 and ExM-12 in the above-described layers were replaced by the magenta coupler M-2 according to the present invention in their respective equimolar amounts. Further, Sample No. 303 was prepared in the same manner as Sample No. 302, except that the high boiling organic solvents were replaced by the high boiling organic solvent SO-37 according to the present invention in their respective equiweights.

These samples were subjected to the same exposure and photographic processing operations as in Example 1 of EP-A-0436938, and then examined for density of developed magenta color.

Another set of the samples was prepared, and subjected to the same processing operations as described above, except that the pH of the color developer was changed from 10.05 to 9.75, followed by the measurement of developed magenta color density similarly to the above.

As a result of comparison between the magenta densities obtained under two different developing conditions, it was confirmed that Sample Nos. 301 and 303, in which the high boiling organic solvents according to the present invention were used respectively, were smaller in density change than their corresponding samples, that is, the sample 106 and Sample No. 302 respectively.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one light-sensitive silver halide emulsion layer which comprises a high boiling organic solvent represented by the following formula (SO):

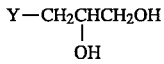

(SO)

wherein Y represents a substituent group represented by the following formula (A) or (B):

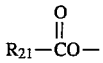

(A)

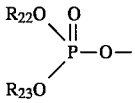

(B)

wherein $R_{21}$ in the formula (A) represents an aliphatic or aryl group containing 9 to 40 carbon atoms, and $R_{22}$ and $R_{23}$ in the formula (B) each represents an aliphatic or aryl group containing 6 to 40 carbon atoms.

2. The silver halide color photographic material as claimed in claim 1, wherein Y represents formula (A).

3. The silver halide color photographic material as claimed in claim 8, wherein $R_{21}$ is an aliphatic group containing 11 to 30 carbon atoms.

4. The silver halide color photographic material as claimed in claim 1, wherein Y represents formula (B).

5. The silver halide color photographic material as claimed in claim 4, wherein $R_{22}$ and $R_{23}$ are each aliphatic groups containing 8 to 30 carbon atoms.

6. A silver halide color photographic material comprising a support having provided thereon at least one light-sensitive silver halide emulsion layer which comprises both a high boiling organic solvent represented by the following formula (SO) and a coupler represented by one of the following formulas (M-I), (M-II), (M-III), or (M-IV):

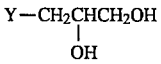

(SO)

wherein Y represents a substituent group represented by the following formula (A), (B) or (C):

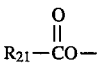

(A)

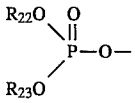

(B)

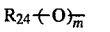

(C)

wherein $R_{21}$ in the formula (A) represents an aliphatic or aryl group containing 9 to 40 carbon atoms, $R_{22}$ and $R_{23}$ in the formula (B) each represents an aliphatic or aryl group containing 6 to 40 carbon atoms, $R_{24}$ in the formula (C) represents an aliphatic or aryl group containing 6 to 40 carbon atoms, and m represents 0 or 1;

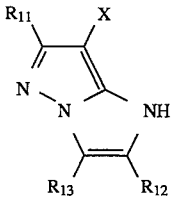

(M-I)

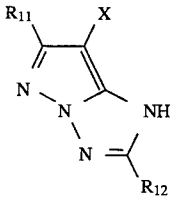

(M-II)

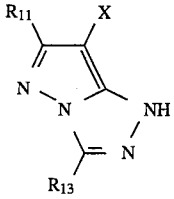

(M-III)

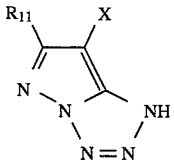

(M-IV)

wherein $R_{11}$, $R_{12}$, and $R_{13}$ each independently represent a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclyloxy group, an azo group, an acyloxy group, a carbamoyloxy group, and silyloxy group, an aryloxycarbonylamino group, an imido group, a heterocyclylthio group, a sulfinyl group, a phophonyl group, an aryloxycarbonyl group, an acyl group or an azolyl group, and X represents a group capable of splitting off upon coupling reaction with an oxidation product of a developing agent.

7. The silver halide color photographic material as claimed in claim 6, wherein the ratio of the weight of the high boiling organic solvent to the weight of the coupler ranges from 0.01 to 10.

8. The silver halide color photographic material as claimed in claim 6, wherein Y represents formula (A).

9. The silver halide color photographic material as claimed in claim 8, wherein $R_{21}$ is an aliphatic group containing 11 to 30 carbon atoms.

10. The silver halide color photographic material as claimed in claim 6, wherein Y represents formula (B).

11. The silver halide color photographic material as claimed in claim 10, wherein $R_{22}$ and $R_{23}$ are each aliphatic groups containing 8 to 30 carbon atoms.

12. The silver halide color photographic material as claimed in claim 6, wherein Y represents formula (C).

13. The silver halide color photographic material as claimed in claim 12, wherein $R_{24}$ is an unsubstituted aliphatic group containing 8 to 30 carbon atoms and m is 1.

14. A silver halide color photographic material comprising a support having provided thereon at least one light-sensitive silver halide emulsion layer which comprises both a high boiling organic solvent represented by the following formula (SO) and a coupler represented by one of the following formulas (M-I), (M-II), (M-III), or (M-IV):

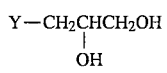

(SO)

wherein Y represents a substituent group represented by the following formula (A) or (B):

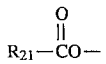

(A)

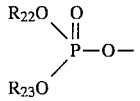

(B)

wherein $R_{21}$ in the formula (A) represents an aliphatic or aryl group containing 9 to 40 carbon atoms, $R_{22}$ and $R_{23}$ in the formula (B) each represents an aliphatic or aryl group containing 6 to 40 carbon atoms;

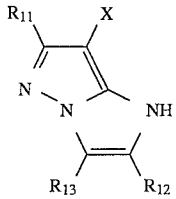

(M-I)

-continued

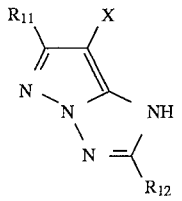

(M-II)

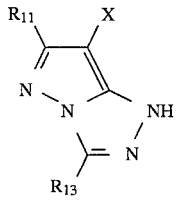

(M-III)

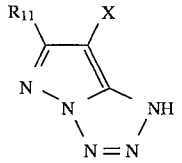

(M-IV)

wherein $R_{11}$, $R_{12}$, and $R_{13}$ each independently represent a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclyloxy group, an azo group, an acyloxy group, a carbamoyloxy group, a silyloxy group, an aryloxycarbonylamino group, an imido group, a heterocyclylthio group, a sulfinyl group, a phosphonyl group, an aryloxycarbonyl group, an acyl group or an azolyl group, and X represents a group capable of splitting off upon coupling reaction with an oxidation product of a developing agent.

15. The silver halide color photographic material as claimed in claim 3, wherein the ratio of the weight of the high boiling organic solvent to the weight of a coupler ranges from 0.01 to 10.

16. The silver halide color photographic material as claimed in claim 14, wherein said material is color reversal film.

17. The silver halide color photographic material as claimed in claim 14, wherein Y represents formula (A), and $R_{21}$ is an unsubstituted aliphatic group containing 11 to 30 carbon atoms.

* * * * *